US007540127B2

(12) United States Patent
Sung et al.

(10) Patent No.: US 7,540,127 B2
(45) Date of Patent: Jun. 2, 2009

(54) VACUUM SEALER

(75) Inventors: Yi-Je Sung, 25-1201 Dong-a Apt, Bupyeong-dong, Bupyeong-gu, Incheon (KR) 403-762; Joon-Chel Shin, Seoul (KR)

(73) Assignee: Yi-Je Sung (KR)

( * ) Notice: Subject to any disclaimer, the term of this patent is extended or adjusted under 35 U.S.C. 154(b) by 0 days.

(21) Appl. No.: 11/743,507

(22) Filed: May 2, 2007

(65) Prior Publication Data

US 2007/0199283 A1 Aug. 30, 2007

Related U.S. Application Data

(63) Continuation-in-part of application No. 10/921,049, filed on Aug. 17, 2004, now abandoned.

(51) Int. Cl.
*B65B 31/04* (2006.01)

(52) U.S. Cl. ..... 53/512; 53/510; 53/79; 53/434

(58) Field of Classification Search ..... 53/79, 53/432, 434, 510, 512; 22/108, 152
See application file for complete search history.

(56) References Cited

U.S. PATENT DOCUMENTS 4,860,523 A * 8/1989 Teteishi et al. ..... 53/512
4,941,310 A * 7/1990 Kristen ..... 53/512
6,694,710 B2 * 2/2004 Wang ..... 53/512
7,000,367 B2 * 2/2006 Sung ..... 53/510
7,076,929 B2 * 7/2006 Patterson et al. ..... 53/405
7,134,259 B2 * 11/2006 Huang ..... 53/512
7,146,783 B2 * 12/2006 Levsen et al. ..... 53/512
7,204,067 B2 * 4/2007 Baptista ..... 53/434
7,207,160 B2 * 4/2007 Baptista ..... 53/512
7,231,753 B2 * 6/2007 Patterson et al. ..... 53/512
2004/0065051 A1 * 4/2004 Patterson et al. ..... 53/432

* cited by examiner

*Primary Examiner*—Hemant M Desai
(74) *Attorney, Agent, or Firm*—Booth Udall, PLC

(57) ABSTRACT

Disclosed herein is a vacuum sealer, which exhausts air from a thermal adhesive vacuum bag containing products and then heats and seals the open end of the vacuum bag. The vacuum sealer includes a lower body. An upper body is pivotably mounted to the lower body in such a way as to engage with the lower body. A heater is installed in either or both the lower body or/and the upper body, and heats and seals a vacuum bag. A vacuum space creating member is installed in either or both the lower body or/and the upper body, and isolates an end of the vacuum bag which is evacuated from an exterior, thus creating a vacuum space. A vacuum pump is coupled via a tube to an exhaust hole communicating with the vacuum space created by the vacuum space creating member.

19 Claims, 23 Drawing Sheets

VACUUM SEALER

BACKGROUND OF THE INVENTION

1. Field of the Invention

The present invention relates generally to a vacuum sealer, which exhausts air from a thermal adhesive vacuum bag containing products such as foodstuffs, and then heats and seals the open end of the vacuum bag, and, more particularly, to a vacuum sealer, which uses a linear packing member, in place of a closed-loop shaped packing member, used in a conventional vacuum sealer, thus simplifying the construction of a body accommodating a vacuum pump, in addition to maintaining the same vacuum level as a conventional vacuum sealer, and which includes a detachable vacuum space creating member at which the end of the vacuum bag is located and to which vacuum pressure is applied using a pump, a vacuum release means which supplies external air into a vacuum space so as to release the vacuum after air has been exhausted from the vacuum bag and the end of the vacuum bag is heated and sealed, and a filtering means which prevents impurities, discharged from the products during a vacuum creating operation, from entering the pump, and which is constructed so that an upper body contacts a lower body even if a user does not continue to press the upper body during the vacuum creating operation, thus being convenient for the user.

2. Description of the Related Art

Recently, vacuum sealers have been widely used in restaurants and food shops. The vacuum sealers are used to vacuum pack products, such as foodstuffs or cooked food, so as to prevent the products from decaying, thus prolonging the usable life of the products. Further, there is a growing tendency for people to go shopping on weekends in large discount shops, in addition to the increase number of nuclear families, so that food may be stored in refrigerators for about a week. For these reasons, the sales of household vacuum sealers have increased.

In most conventional vacuum sealers, closed-loop shaped packing members, which are sealing members provided on upper and lower bodies of the vacuum sealer, are mounted to both the upper body and the lower body.

When the upper body contacts the lower body, a vacuum chamber is defined between the sealing members. Vacuum pressure is applied to the vacuum chamber by a pump. Since embossments are formed on the surface of a vacuum bag, the end of which is located in the vacuum chamber, it is possible to evacuate the vacuum bag.

When a pair of closed-loop shaped sealing members is provided, as in the conventional vacuum sealer, a vacuumizing operation can be efficiently achieved using only one of the two closed-loop shaped packing members. The other packing member serves only to seal the end of the vacuum bag. Based on this, the construction of the vacuum sealer can be further simplified, and material costs can be reduced.

Generally, a vacuum sealer includes a lower body in which heavy parts, such as a heater and a vacuum pump, are provided, and an upper body which is hinged to the lower body. A vacuum bag, which is placed in a vacuum space defined by sealing members when the upper body closes the lower body is evacuated, and one end of the vacuum bag is heated to be sealed. Afterwards, external air must be supplied to the vacuum space using a vacuum release means so that the vacuum bag can be easily separated from the vacuum sealer. The prior art relating to the vacuum release means is disclosed in Korean Patent No. 0538520, which was filed by the applicant of the present invention, was registered on Dec. 16, 2005, and is entitled ⌜Vacuum Sealer Having Vacuum Release Means⌟, and Korean Patent No. 0500961, which was filed by the applicant of the present invention, was registered on Jul. 4, 2005, and is entitled ⌜Vacuum Sealer Capable of Simultaneously Performing Locking Operation and Vacuum Releasing Operation⌟. According to the cited documents, the vacuum release means of the vacuum sealer is manually operated. Thus, in order to afford convenience of use, the automation of the vacuum release means is required.

Further, since a vacuum space creating member is provided in the lower body, liquid discharged from a vacuum bag, such as gravy, may gather in a vacuum channel. Thus, in order to repeatedly separate and wash the vacuum space creating member, a detachable vacuum space creating member is shown in FIG. 4 of Korean Patent Laid-Open Publication No. 2005-0107107, which was filed by the applicant of the present invention, was published on Nov. 11, 2005, and is entitled ⌜Vacuum Sealer Having Partial Open Type Vacuum Channel⌟. However, the detachable vacuum space creating member of the conventional vacuum sealer, disclosed in Patent Laid-Open Publication No. 2005-0107107, is not installed or detached in a fixed direction. When liquid, such as gravy, or impurities, which flow out from the products contained in the vacuum bag during the vacuum packing operation of the vacuum bag, gather in the channel, the vacuum space creating member must be repeatedly detached or attached in order to wash the channel. Because of this repeated detachment and attachment, a gap may form at the coupling site, and leakage may occur at an exhaust passage coupled to a vacuum pump, thus resulting in reduced durability of the product. If the vacuum space creating member of the conventional vacuum sealer is called a "two-sided detachable" member, the vacuum space creating member according to the present invention may be called a "one-sided detachable" member.

Further, in order to bring the upper body securely into contact with the lower body, even if a user does not press the vacuum space formed by general loop-shaped sealing members when the vacuum bag is evacuated and sealed using the vacuum sealer, Korean Patent No. 0500961, which was filed by the applicant of this invention, and Korean U.M. Registration No. 0405381 which was filed by An JunYoung, was registered on Jan. 2, 2006, and is entitled ⌜Vacuum Sealer Having Heating Function⌟ have been proposed. Both of the documents maintain the engagement of the lower body with the upper body using a hook-type locking means. However, a user must push a button provided on the side surface of the lower body in order to release the locked state of the hook. Therefore, when the vacuum sealer is used at first, the hook and the latch are stiff, so that it is difficult for weak users to use the vacuum sealer. Further, after the vacuum sealer has been used for a lengthy period of time, the hook and the latch may wear out or break. Moreover, the conventional vacuum sealer is usually placed on a dining room table or a kitchen table for use. However, when the space is narrow, the space cannot support products contained in the vacuum bag, so that a vacuum packing operation cannot be performed smoothly.

SUMMARY OF THE INVENTION

Accordingly, the present invention has been made keeping in mind the above problems occurring in the prior art, and an object of the present invention is to provide a vacuum sealer, in which a packing member provided on a lower body has a linear shape, thus simplifying the construction of the vacuum sealer.

Another object of the present invention is to provide a vacuum sealer having a vacuum release means which uses a solenoid valve so as to release a vacuum by supplying external air into a vacuum space, after air is exhausted from a vacuum bag and the end of the vacuum bag is heated to be sealed.

A further object of the present invention is to provide a vacuum sealer, in which a vacuum channel, defining a vacuum space at which an end of a vacuum bag containing a product to be packed is located comprises a separable member, thus permitting the detachment and attachment of the vacuum channel, and which provides a "one-sided detachable" vacuum space creating member, thus preventing leakage from occurring in an exhaust passage coupled to a vacuum pump even after the vacuum sealer has been used for a lengthy period of time. The vacuum space creating member of this invention is constructed as follows. That is, a holding part, provided in a lower body and/or an upper body so as to provide the vacuum space creating member, and the vacuum space creating member are attached to or detached from each other using a pair of supporting parts and detaching parts, so that the supporting parts are fastened first when the holding part and the vacuum space creating member are attached to each other, and the detaching parts are detached first when the holding part and the vacuum space creating member are separated from each other.

Yet another object of the present invention is to provide a vacuum sealer, which includes a one-touch type locking means, so that a locking bar is locked when the locking means is pushed once, and the locking bar is unlocked when the locking means is pushed once more, thus allowing a vacuum space, isolated from the exterior by sealing members when an upper body engages with a lower body, to be easily created or released.

A still further object of the present invention is to provide a vacuum sealer, in which a support means for supporting a product is provided on the front of a lower body, which is hinged to an upper body.

An additional object of the present invention is to provide a vacuum sealer, which includes a silencer, thus preventing noise from being generated when an evacuation operation is conducted by a vacuum pump.

In order to accomplish the above objects, the present invention provides a vacuum sealer, including a lower body, an upper body pivotably mounted to the lower body in such a way as to engage with the lower body, a heater which is installed in either or both the lower body or/and the upper body and heats and seals a vacuum bag, a vacuum space creating member which is installed in either or both the lower body or/and the upper body, and isolates an end of the vacuum bag which is evacuated from an exterior, thus creating a vacuum space, and a vacuum pump which is coupled via a tube to an exhaust hole communicating with the vacuum space created by the vacuum space creating member.

The vacuum space creating member includes a linear packing member provided on the lower body, and a closed-loop shaped sealing member provided on the upper body, thus creating a vacuum space. The lower body further includes a guide member for guiding the end of the vacuum bag to a predetermined position in the vacuum space.

The lower body comprises a liquid guide channel for guiding liquid discharged from the vacuum bag. The liquid guide channel is inclined towards a suction nozzle.

According to this invention, the lower body has a depressed part, thus allowing liquid impurities discharged from the vacuum bag containing a product to gather in the depressed part, therefore preventing the pump from being soiled and broken due to the impurities. Further, the depressed part is formed in a detachable member which is separable from a holding part of the lower body, so that it is possible to clean the depressed part after it is separated.

Further, the vacuum space creating member is preferably provided in the detachable member, which is separable from the holding part of the lower body. The detachable member includes a supporting part which is coupled to a supporting part provided on a first side of the holding part of the lower body, and a detaching part which is coupled to a detaching part provided on a second side of the holding part, so that, when the detachable member is installed in the holding part, the supporting parts are coupled to each other first in a male-female-coupling method, and when the detachable member is removed from the holding part, the detaching parts are detached from each other first. As such, the detachable member is constructed to be a 'one-sided detachable member', thus preventing leakage from occurring in an exhaust passage coupled to the vacuum pump even if the vacuum sealer has been used for a lengthy period of time.

Further, the vacuum sealer further includes a vacuum release means which supplies air into the vacuum space, thus releasing vacuum from the vacuum space after the vacuum bag is evacuated and the end of the vacuum bag is heated and sealed, therefore allowing the upper body to be easily separated from the lower body.

The vacuum release means includes a solenoid valve provided in the tube coupling the exhaust hole formed in the vacuum space with the vacuum pump, and an air inlet part supplying external air to the vacuum space through the solenoid valve, so that the vacuum can be automatically released.

Alternatively, the vacuum release means may include a lever hinged to the upper body or the lower body; an elastic member restoring the lever to an original position thereof; a packing disc provided on a contact surface of the lever with the lower body or the upper body; and an air inlet part opened or closed by the packing disc, and communicating with the tube coupled to the vacuum pump, so that the vacuum can manually released.

The vacuum sealer further includes a filtering means which is provided on the tube coupling the exhaust hole formed in the vacuum space with the vacuum pump, and filters impurities, thus preventing liquid, such as gravy, and impurities from entering the pump. The filtering means is mounted to the lower body or the upper body to be exposed outside, so that the maintenance of the filtering means is easy.

Further, the vacuum sealer includes a locking means for maintaining engagement of the upper body with the lower body, thus eliminating the need to continuously press the upper body during the sealing operation of the vacuum bag, therefore affording convenience.

The locking means includes a button provided on an upper surface of the upper body to be exposed to the outside, a lever provided in the upper body and having a hook which is moved by pushing the button, and a hook coupling part provided at a predetermined position in the lower body to be coupled to the hook of the lever. Further, the vacuum sealer includes a vacuum release means, having an air inlet part communicating with the tube, which couples the exhaust hole formed in the vacuum space with the vacuum pump, and a control member opening or closing the air inlet part, wherein the button of the locking means moves the control member, thus opening or closing the air inlet part. Thus, when the locking means is unlocked, vacuum is simultaneously released from the vacuum space.

Further, in order to provide a one-touch type locking means, a locking bar is provided on the lower body or the upper body, and a locking unit is provided on the upper body or the lower body to engage with the locking bar. The locking unit is operated in conjunction with a spring, so that the locking unit engages with the locking bar when the locking unit is pressed once, and disengages from the locking bar when the locking unit is pressed once more.

Moreover, according to the intended purpose of a product, the pump and the heater may be provided on the upper body.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
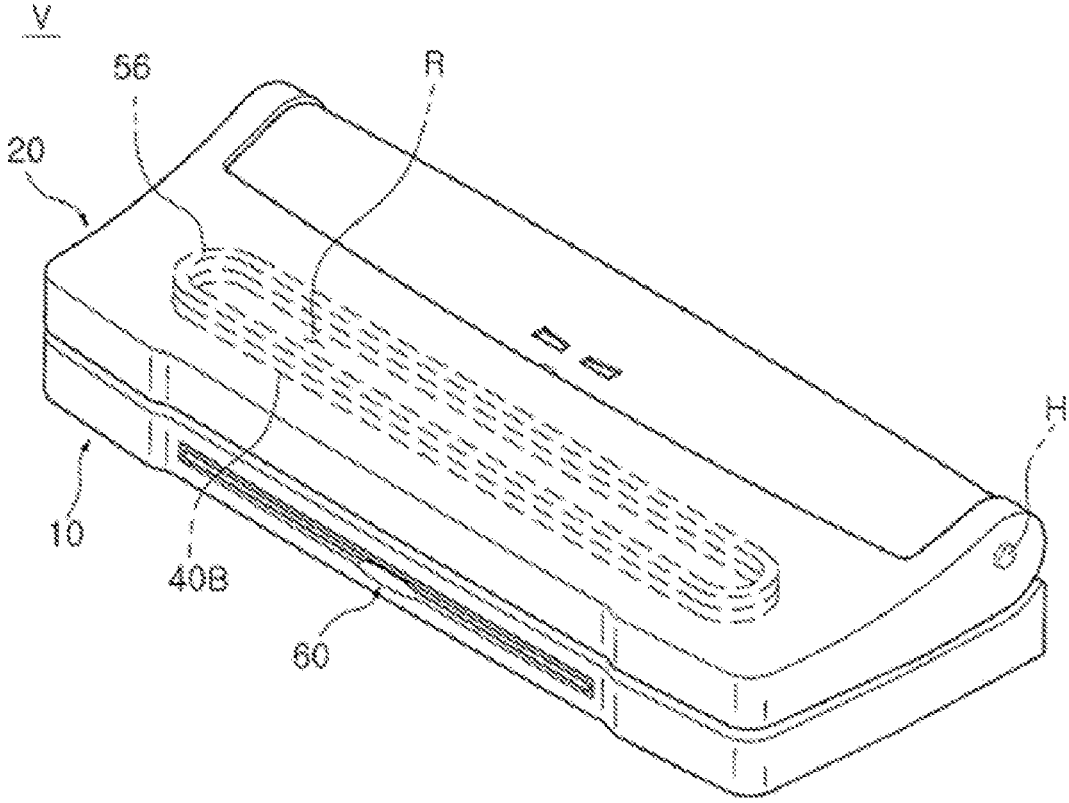
FIG. 1 is a perspective view showing a vacuum sealer, according to the present invention, in which an upper body closes a lower body.

The present invention will be described below in detail with reference to the accompanying drawings. The same reference numerals throughout the drawings, that is, the same reference numerals in a second digit and a first digit, or in a second digit, a first digit, and an alphabet character, denote elements having the same function. If there is no special mention, the elements denoted by the reference numerals are to be taken as elements complying with the above-mentioned reference scheme. The orientation of the vacuum sealer V according to the present invention is specified with reference to FIGS. 1 and 2. That is, the position of an element 10 which is located at a lower position when seen from the direction in which gravity acts, and holds important parts, such as a heater 30 and a pump 40 (see, FIG. 11) is set as a lower position, and the element 10 is designated as a 'lower body'. The position opposite the position of the lower body is set as an upper position, and an element mounted to the lower body 10 via a pivot shaft H is designated as an 'upper body' 20. Further, the position of the pivot shaft H of the upper body 20, which rotates relative to the lower body 10, is set as a rear position. The position which is opposite the pivot shaft H and is around upper and lower channels C' and C, forming the vacuum space R when the upper body engages with the lower body, is set as a front position.

Figure 2:
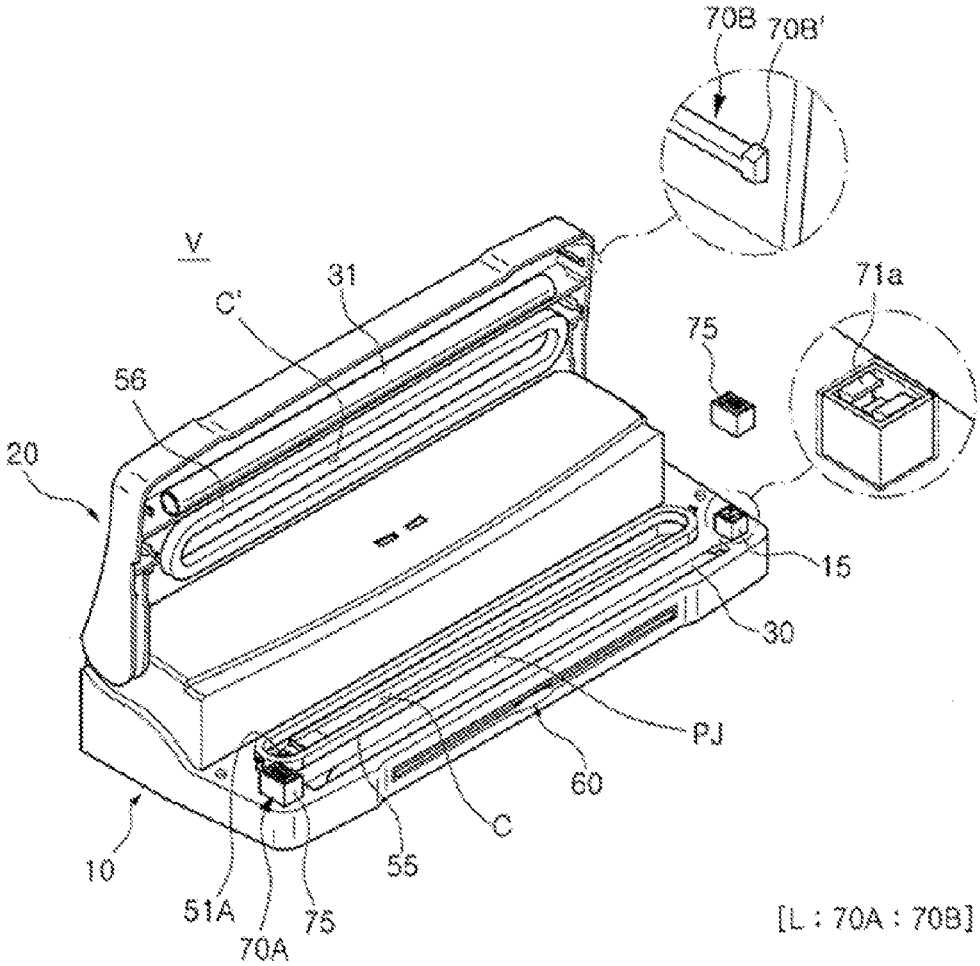
FIGS. 2 and 3 are perspective views showing the vacuum sealer, according to the present invention, in which the upper body is in an open position relative to the lower body.
Figure 3:
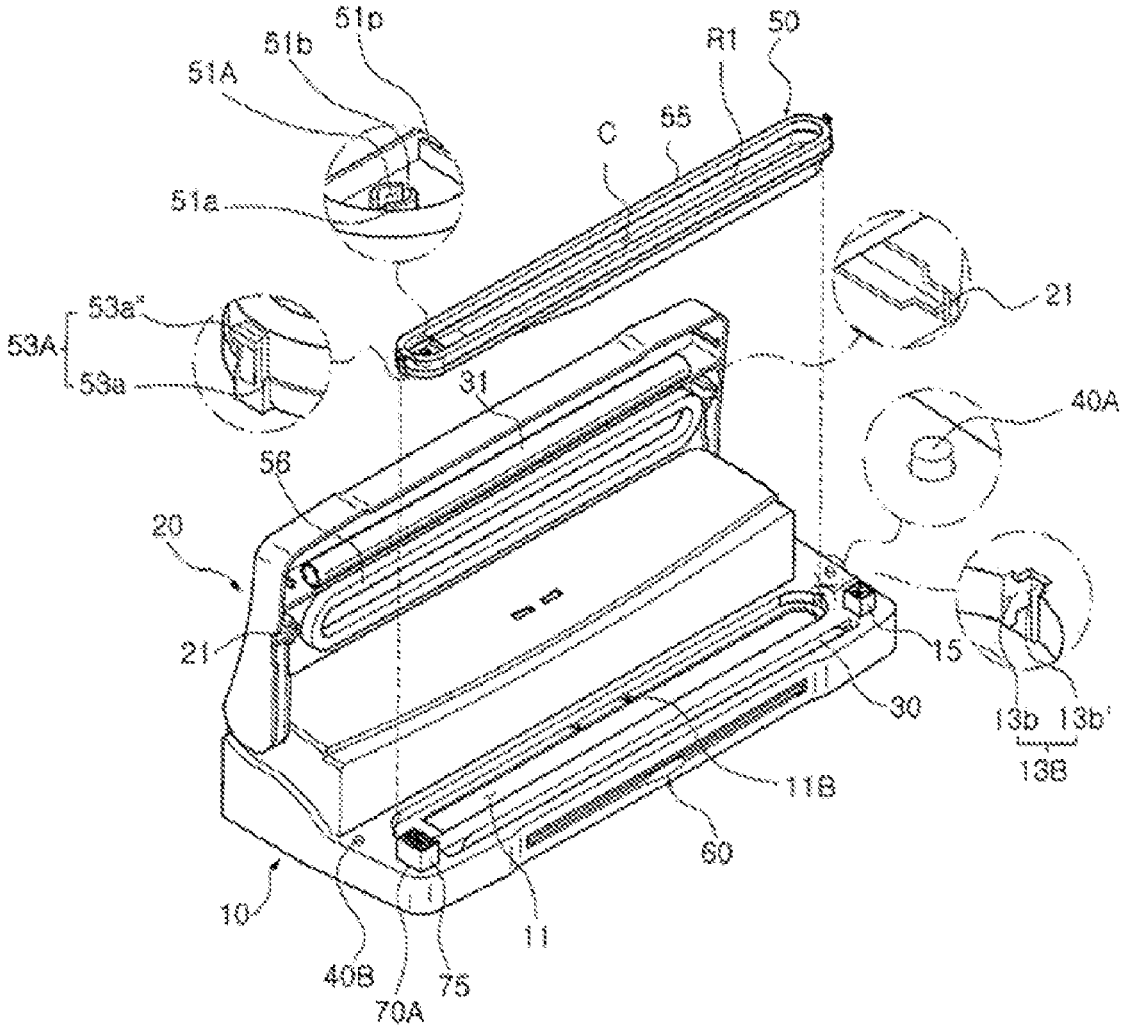

Referring to FIGS. 1, 2, and 3, a vacuum sealer V according to the present invention includes a lower body 10 in which main parts, including a vacuum pump, are installed, and an upper body 20, which is coupled to the lower body 10 via a longitudinally extending pivot shaft H, and which is lighter than the lower body 10. The vacuum sealer of this invention, which is shown in the drawings, and the known vacuum sealer are both constructed so that the upper body 20 pivots on the lengthwise axis of the rear portion of the lower body 10. However, as necessary, the upper body may pivot on the widthwise axis of the side surface of the lower body. The characteristics of the invention may be applied regardless of the arrangement of the pivot shaft, on which the upper body pivots relative to the lower body. Further, several parts, including a pump and a heater, may not be installed in the lower body, but may be installed in the upper body. In this case, in order to prevent the balance of the vacuum sealer from being upset by the relatively heavy upper body, additional weight may be provided on the lower body, or the lower body may be fixed to a predetermined place, such as a shelf. When the pump, the heater, and other parts are installed in the upper body, the following advantages are realized. That is, the engagement of the upper body with the lower body is maintained by the weight of the upper body. Thus, even if a user does not press the upper body when a vacuum space R is created, a firmer engagement is achieved. Further, such a construction assists a locking means, which will be described later and locks the engagement of the upper body with the lower body, thus allowing the vacuum sealer to be variously designed.

Figure 9:
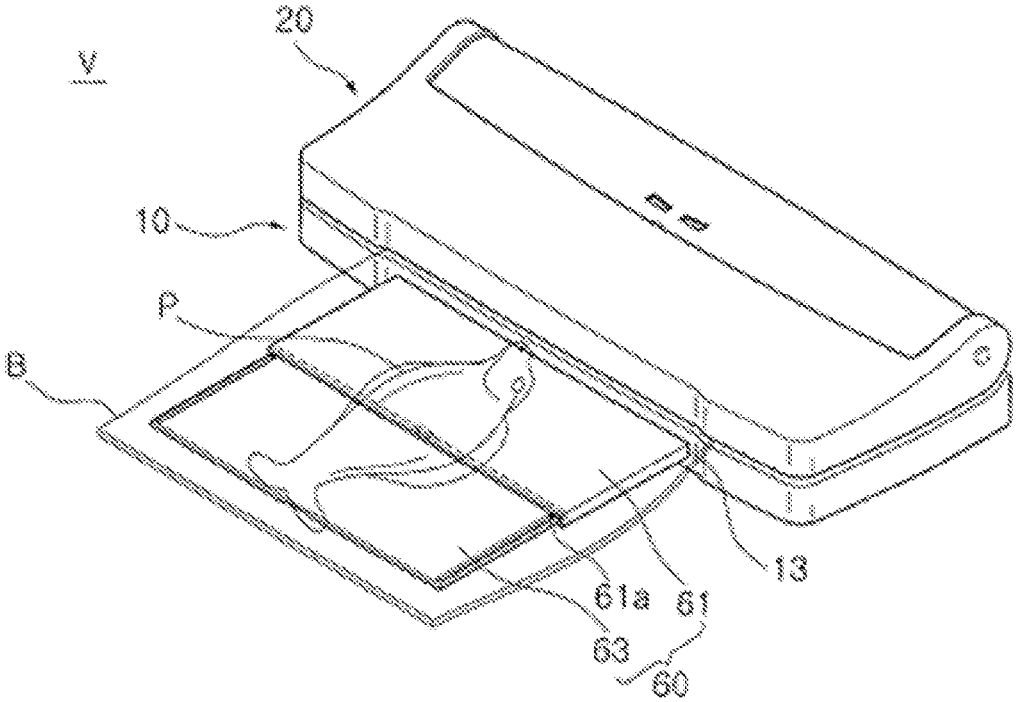
FIGS. 9 and 10 are perspective views showing different types of product support means.

Referring to FIGS. 2 and 9, a heater 30 which heats and seals one end of a vacuum bag B containing a product P, is provided in the lower body 10. In order to make the end of the vacuum bag more reliably contact the heater 30, a pressing member 31 may be provided at a position on the upper body 20 to engage with the heater 30. If necessary, the position of the heater may be exchanged with that of the pressing member.

Preferably, vacuum channels C and C' are provided to isolate the end of the vacuum bag B, which is evacuated when the upper body 20 pivots on the pivot shaft H and closes the lower body 10, from the exterior, thus forming a vacuum space R. Referring to the drawings, the vacuum channels C and C', provided in the lower body 10 and the upper body 20, are encircled with continuous loop-shaped sealing members 55 and 56. The sealing members are mounted to mounting holes (not shown) which are formed in the upper and lower bodies. The loop-shaped sealing members 55 and 56 constitute the vacuum space creating member 50 of this invention. As necessary, the sealing members may, rather than being provided on both the upper and lower bodies, be provided on either the upper or lower body. The example is shown in FIG.

Figure 6:
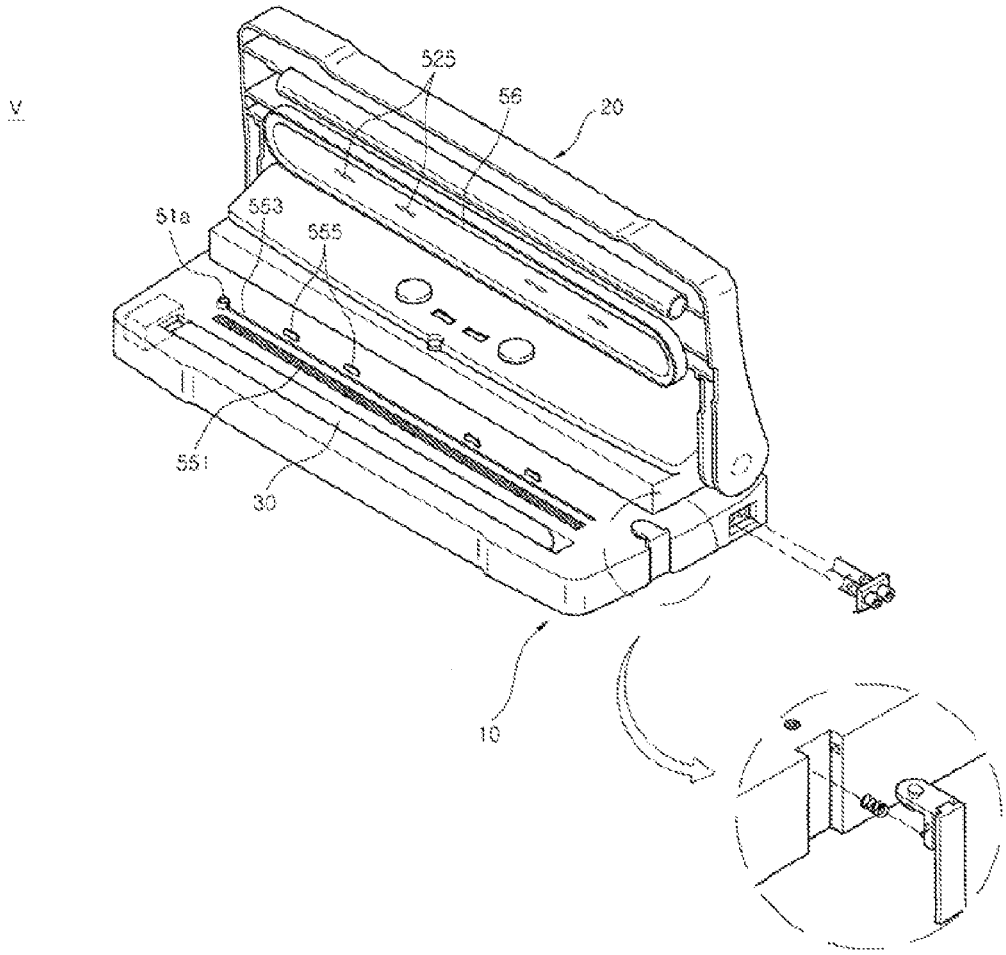
FIG. 6 is a perspective view showing the vacuum sealer having a linear packing member, which is provided in the lower body of the vacuum sealer, according to the present invention.

6. Referring to FIG. 6, the sealing member provided on the lower body 10 is a linear packing member 551, and the sealing member provided on the upper body 20 is a closed-loop shaped sealing member 56, and is embedded in a support member. The linear packing member 551 mounted to the lower body 10 is in the same plane as the upper surface of the lower body 10, and the sealing member 56 mounted to the upper body 20 is in the same plane as the upper surface of the support member. As in the vacuum sealer V of FIG. 6, the linear packing member provided in the lower body 10 simplifies the construction of the vacuum sealer, in addition to reducing the material cost.

Further, the vacuum sealer V of FIG. 6 further includes a guide member which positions the end of the vacuum bag within the edge of the closed-loop shaped sealing member 56 provided on the upper body 20, that is, guides the end of the vacuum bag into the vacuum channel. As shown in the drawing, the guide member comprises two or more protrusions 555 which are arranged along an imaginary linear line. Preferably, protrusion fitting holes 525 are provided in the upper body 20 so that the protrusions 555 are fitted into the protrusion fitting holes 525, when the upper body engages with the lower body.

Further, a liquid guide channel 553 is provided on the lower body 10 in such a way as to be aligned with a suction nozzle 51*a* in a row, and guides liquid discharged from the vacuum bag. Preferably, the liquid guide channel 553 is inclined towards the suction nozzle 51*a*.

Further, as shown in FIGS. 2, 3, 4, and 5, a "one-sided detachable" member 50, which is one of the important parts of the vacuum sealer V of this invention, is provided in a holding part 11 of the lower body 10. Unlike the vacuum channel C' of the upper body 20, an inclined part R1*a* extends from the vacuum channel C, provided in the lower body 10, and a depressed part R1, which is deeper than the vacuum channel C, extends from the inclined part (see, FIGS. 3 and 4). In particular, the inclined part R1*a* is gradually inclined in the direction which is far away from an exhaust hole 51A, which is coupled to a vacuum pump 40 to generate vacuum pressure in the vacuum space R and is formed at one side (left side when seen in the drawing) of the vacuum space creating member. Such a construction prevents liquid, such as gravy, or impurities from entering the pump 40, in addition to allowing liquid or impurities to easily gather in the depressed part R1. In other words, the depressed part of the vacuum sealer V, in which liquid, such as gravy, or impurities produced from the product P gather, is provided in the lower body. Further, the depressed part R1 and the sealing member 55 constituting the vacuum space creating member are provided in the detachable, particularly, one-sided detachable, member 50.

Figure 4:
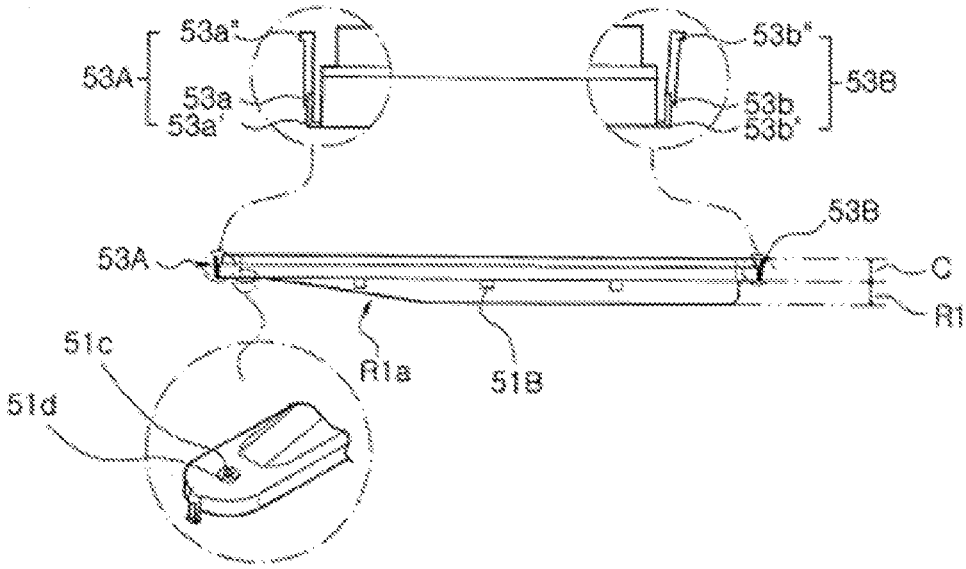
FIG. 4 is a front view showing a vacuum space creating member of the vacuum sealer, according to the present invention.
Figure 5:
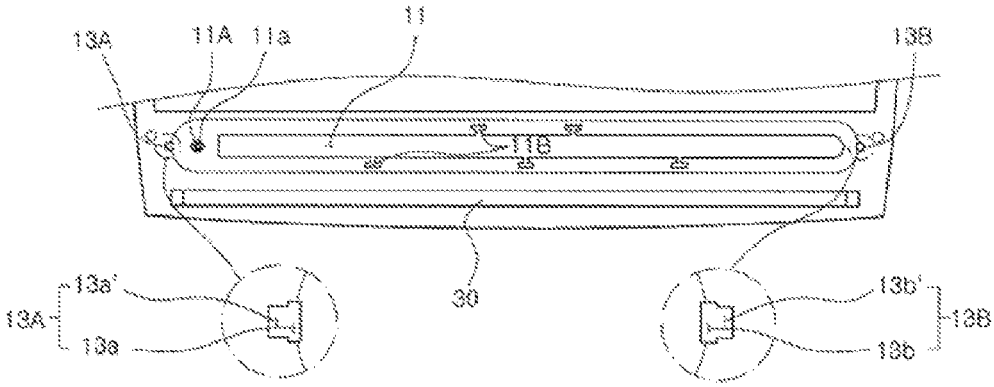
FIG. 5 is a partial plan view showing a holding part of the lower body of the vacuum sealer, according to the present invention.

Referring to FIGS. 3 and 4, the exhaust hole 51A is formed in a protruding nozzle 51*a*. The nozzle 51*a* has cut slits 51*b*, thus preventing the opening of the nozzle 51*a* from being blocked by the vacuum bag B. A partition wall 51*p* is provided to the right of the nozzle 51*a*, thus preventing liquid or impurities from flowing into the exhaust hole 51A (see, the enlarged portion encircled in the upper portion of FIG. 3). Further, as shown in FIGS. 3, 4, and 5, a communication hole 11A is formed at a position around the holding part 11, which is provided in the lower body 10 to hold the vacuum space creating member 50, and is surrounded with an annular step 11*a*. An insert part 51*c*, which protrudes slightly and is surrounded with a sealing ring 51*d*, is provided on the side opposite the exhaust hole 51A of the vacuum space creating member 50 (see the inverted and enlarged portion encircled in the lower portion of FIG. 4 and). When the vacuum space creating member 50 is held in the holding part 11, the insert part 51*c* is inserted into the communication hole 11A, and the sealing ring 51*d* is seated on the annular step 11*a* to be in close contact therewith. Consequently, the exhaust hole 51A is in close contact with the communication hole 11A in such a way that it communicates therewith, thus reliably preventing the leakage of air. However, the vacuum space creating member 50 shown in the drawings may be variously changed by those skilled in the art. For example, the exhaust hole coupled to the vacuum pump 40 may be formed in the vacuum channel C' of the upper body. In this case, the ingress of liquid or impurities to the pump 40 can be further reduced. Thus, the vacuum space creating member functions to simply receive liquid or impurities which leak from the product P in the vacuum bag B.

Meanwhile, the nozzle 51*a* defining the exhaust hole 51A may be used to evacuate an external vacuum vessel. The vacuum sealer V is automatically operated under the control of a microprocessor of a control board CB (see, FIG. 11) which constitutes a control unit, when actuating buttons 40A and 40B are pressed by pressure protrusions 21 of the upper body 20, so that the pump 40, the heater 30, and a solenoid valve SV comprising a vacuum release means are sequentially operated. When the right actuating button 40A is pushed with the right hand, one end of the connector is connected to the nozzle 51*a*, and the other end of the connector is connected to the vacuum vessel, the external vessel can be evacuated. The operation will be described later.

A supporting part 53A and a detaching part 53B, which are the most important parts of the one-sided detachable vacuum space creating member 50, will be described with reference to FIGS. 2 to 5. The supporting part and the detaching part of the creating member are components that correspond to a supporting part 13A provided on one side (the left side in the drawing) of the holding part 11 of the lower body 10 and a detaching part 13B provided on the other side (the right side in the drawing). The supporting parts 13A and 53A are provided on the left side for the following reason. As described above, the vacuum space creating member 50 is provided in the lower body 10, so that liquid, such as gravy, or impurities discharged from the vacuum bag B gather in the depressed part R1, which is provided under the vacuum channel C. In this case, after the creating member is detached and washed, it must be installed in the lower body again. Thus, through a separation method in which only the right detaching parts are manipulated, the portion around the exhaust hole 51A of the vacuum space creating member 50, which must be repeatedly connected to or separated from the vacuum pump for generating vacuum pressure in the vacuum space, or must be repeatedly connected to or separated from the communication hole 11A, which is coupled to the vacuum pump 40 via a tube and is formed in the holding part 11, especially the insert part 51*c*, must be reliably sealed. Here, since the exhaust hole 51A and the communication hole 11A are formed in the left side, it is preferable that the supporting parts 13A and 53A be also provided on the left side.

The supporting part 13A and the detaching part 13B provided on both sides of the holding part 11 of the lower body have similar shape and construction. The supporting part 53A and the detaching part 53B of the vacuum space creating member 50 have similar shape and construction. The similar shape and construction affords manufacturing convenience, but is not essential. As shown in FIGS. 3 and 4, the supporting part 53A and the detaching part 53B of the vacuum space creating member 50, include coupling parts 53*a*' and 53*b*', locking steps 53*a* and 53*b*, and catch parts 53*a*" and 53*b*". The coupling parts are provided on both sides of the lower portion of the creating member 50, and provide elasticity because of the characteristics of the material of the coupling parts. The locking steps prevent the vacuum space creating member 50 from being undesirably removed from the holding part 11. The catch parts 53*a*" and 53*b*" allow the supporting part and the detaching part to move leftwards and rightwards relative to the corresponding coupling parts 53*a*' and 53*b*', respectively, and are bent leftwards and rightwards.

As shown in FIGS. 3 and 5, the supporting part 13A and the detaching part 13B of the holding part 11 of the lower body 10 include gate parts 13*a* and 13*b*, and locking parts 13*a*' and 13*b*'. The upper openings of the gate parts have large areas, thus allowing the locking steps 53*a* and 53*b* of the corresponding parts 53A and 53B to be moved upwards and removed. The upper openings of the locking parts have small areas, thus permitting the passage of only the catch parts 53*a*" and 53*b*" while preventing the upward movement of the locking steps 53*a* and 53*b* of the corresponding parts 53A and 53B. As shown in the enlarged view, which is encircled in the lower portion of FIG. 5 (the drawing is slightly exaggerated to promote understanding), the supporting part and the detaching part of the holding part 11 are different from each other in that the gate part 13*b* of the detaching part 13B is longer than the gate part 13*a* of the supporting part 13A, and the locking part 13*b*' of the detaching part 13B is shorter than the locking part 13*a*' of the supporting part 13A.

Thus, the gate part 13*a* of the supporting part 13A is short so that the elasticity of the coupling part 53*a*' of the supporting part 53A of the vacuum space creating member 50 is useless. Conversely, the gate part 13*b* of the detaching part 13B is long enough to use the elasticity of the coupling part 53*b*' of the corresponding detaching part 53B. Thereby, the catch part 53*b*" is pushed leftwards, so that the locking step 53*b* may be moved from the locking part 13*b*' of the detaching part 13B to the gate part 13*b* of the detaching part 13B. Thus, in the state where the finger is placed on the lower portion of the catch part 53*b*" of the corresponding detaching part 53B of the vacuum space creating member 50 and continues to press the catch part leftwards, force is applied upwards. At this time, the locking step 53*b* of the corresponding detaching part 53B passes through the gate part 13*b* and moves upwards. Consequently, the right side of the vacuum space creating member 50 is detached first.

Therefore, the elasticity of the coupling part 53*a*' of the supporting part 53A of the vacuum space creating member 50 is not important. The supporting part 13A of the holding part 11 of the lower body and the corresponding supporting part 53A may have any shape, as long as they have the shape of a protrusion and a depression that engage with each other. Conversely, the detaching part 53B of the vacuum space creating member 50 is elastically supported by an elastic means (the coupling part 53*b*' of the drawing serves as the elastic means). Thus, the detaching part 53B of the vacuum space creating member 50 must be shaped as follows. That is, when no external force is applied, the locking step 53*b* of the detaching part 53B must be located at the locking part 13*b*' of the detaching part 13B of the holding part 11. When external force is applied, the locking step 53*b* must be moved to be located at the gate part 13*b* of the detaching part 13B of the holding part 11.

This concept may be summarized as follows. The supporting part and the corresponding supporting part are shaped to be simply coupled to each other in a male-female-coupling method. Even though external force is applied to the supporting parts in the state where the vacuum space creating member is held in the holding part of the lower body, the supporting part and the corresponding supporting part are shaped to prevent the removal of the creating member. The detaching part and the corresponding detaching part are constructed as follows. That is, a locking protrusion is provided on the creating member or the holding part of the lower body, and is elastically supported by the elastic means so as to be locked or unlocked. A locking hole, engaging with the locking protrusion, is provided at a corresponding position in the corresponding member.

When the "one-sided detachable" vacuum space creating member according to the present invention is used, in place of the conventional "two-sided detachable" vacuum space creating member shown in FIG. 4 of Korean Patent Laid-Open Publication No. 2005-0107107, which was filed by the applicant of the present invention, was published on Nov. 11, 2005, and is entitled ⌈Vacuum Sealer Having Partial Open Type Vacuum Channel⌋, the exhaust hole 51A of the vacuum space creating member 50 which is coupled to the vacuum pump 40 via the tube and is repeatedly coupled to or separated from the communication hole 11A of the holding part 11, is reliably sealed. Thus, a vacuum sealer which is capable of preventing leakage in the exhaust passage coupled to the vacuum pump even after the vacuum sealer has been used for a lengthy period of time is realized.

Preferably, as shown in the drawings, guide means are further provided on the holding part 11 and the vacuum space creating member 50 to guide the holding part and the vacuum space creating member such that they are coupled to each other at a predetermined position, and prevent the holding part and the vacuum space creating member from shaking. As shown in the drawings, the guide means include a plurality of fitting holes 11B which are formed in a flange of the holding part 11, and fitting protrusions 51B which are provided on the lower portion of the edge of the vacuum space creating member 50. Each of the fitting holes 11B and fitting protrusions 51B has a "T" shape, so that undesirable movement of the installed vacuum space creating member is reliably prevented, and the durability of each fitting protrusion 51B is increased.

When the vacuum space creating member 50 is held in the holding part 11, the vacuum space creating member 50 is higher than the upper surface of the lower body 10. Thus, it is preferable that a projection PJ (see, FIG. 2) be provided. When the roll-shaped vacuum bag is cut to a desired length, two overlapping sheets of the vacuum bag are closed at both side surfaces thereof, and are open at front and rear ends thereof. In order to make a bag for containing the product, one end of the sheets must be previously heated to seal it. When a user desires to put one end of the cut sheets into the vacuum sealer V and place the end in the heater 30, the projection PJ allows one end of the cut sheets to be precisely placed in the heater 30, thus affording easy manipulation.

Figure 11:
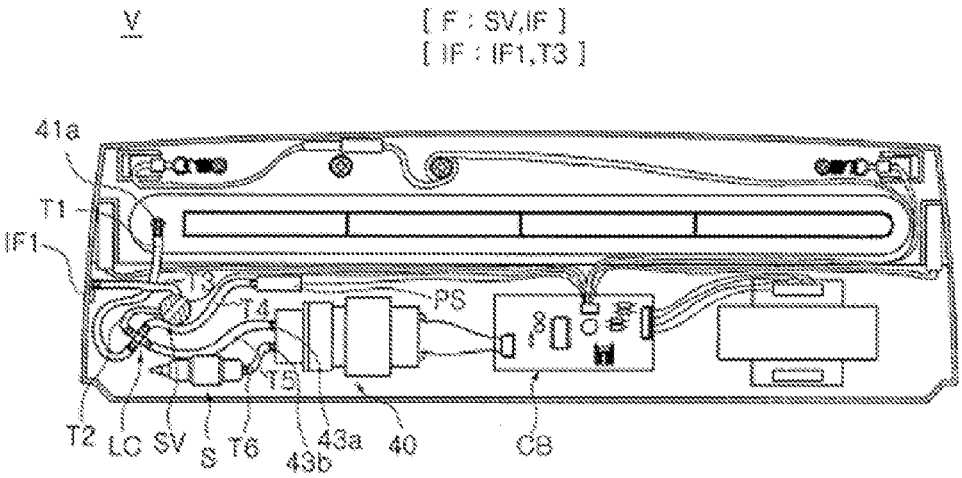
FIG. 11 is a bottom view schematically showing the interior of the vacuum sealer, according to the present invention.

As shown in FIG. 11, the communication hole 11A of the lower body 10, which is in close contact with and communicates with the exhaust hole 51A of the vacuum space creating member 50, has at a lower position a nozzle 41*a*, so that the communication hole is coupled through a tube T1 to the vacuum pump 40. Thus, when the pump is operated, the vacuum space R may be evacuated through the exhaust hole, and the vacuum bag B, the end of which is located in the vacuum space, is evacuated. Further, when the vacuum bag B is located at a central position in the vacuum channels C and C', that is, in the vacuum space R, and the upper body 20 comes into contact with the lower body 10, the actuating buttons 40A and 40B are pressed by the pressure protrusions 21, so that the vacuum pump 40 is automatically operated (although not shown in the drawings, a user may press the actuating buttons to manually operate the vacuum pump, or the vacuum pump may be automatically operated by sensing pressure applied by the upper body). At this time, vacuum pressure acts on the vacuum space R through the exhaust hole 51A, which is coupled to the pump. As necessary, two or more exhaust holes may be formed. In this case, components, including tubes coupling the exhaust holes with the pump, must be provided in a number corresponding to the number of the exhaust holes.

Figure 10:
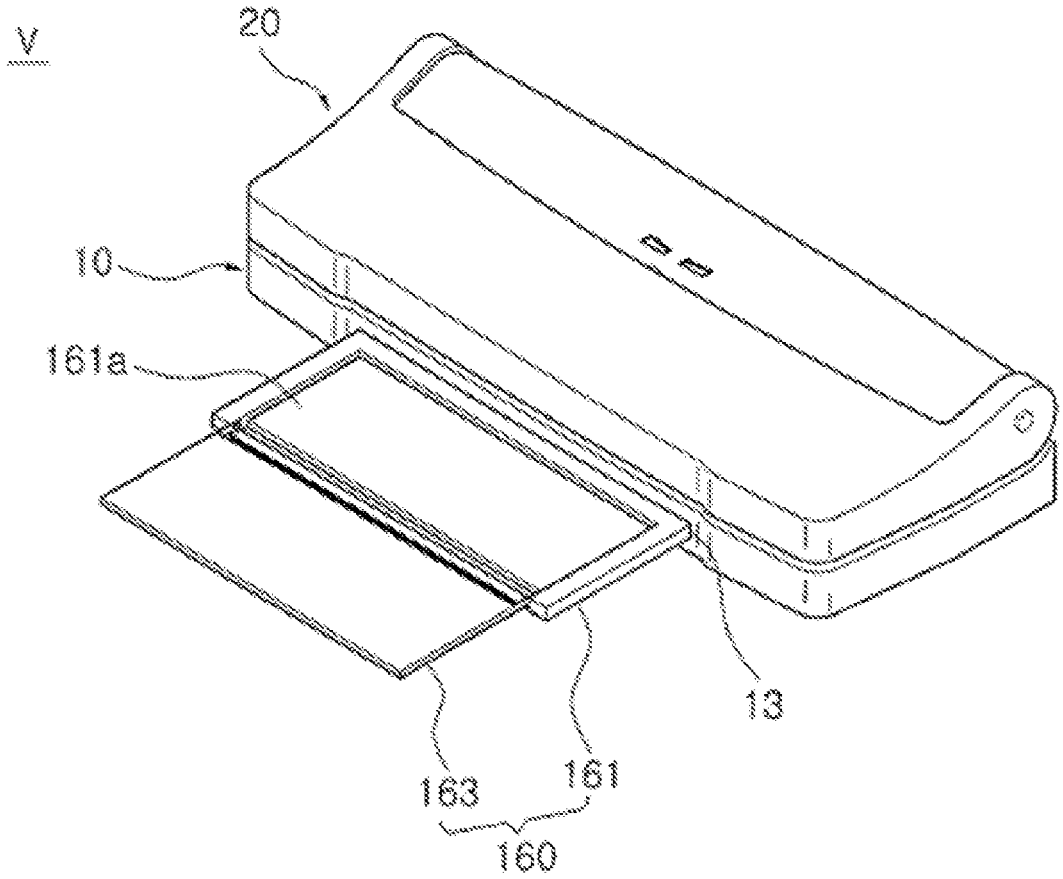

A product support means, which is one of the important parts of the vacuum sealer V according to the present invention and supports the product P, that is, the product P contained in the vacuum bag B, may be variously embodied. For example, the support means may be fixed to the front of the lower body 10 in such a way as to protrude forwards, or may be detachably mounted to the front of the lower body. However, the support means is preferably constructed to be retracted into and extend from the lower body. Such a construction provides a more compact vacuum sealer, thus allowing the vacuum sealer to be easily carried and stored, and provides a larger area for supporting the product, thus affording convenience of use. The retractable and extendable support means may be variously embodied. That is, the support means may have a drawer-type structure or a foldable structure. Further, the support means may be constructed to be folded and unfolded about a rotating shaft, like a fan. More preferably, in order to provide a larger support means and allow the support means to be retracted into the lower body 10, the support means has a multistage structure having a plurality of support pieces. FIGS. 9 and 10 show a complete-drawer-type support means 60 and a partial drawer-partial foldable-multistage support means 160 (two-stage support means shown in the drawing), respectively.

The support means 60 of FIG. 9 is constructed so that left and right ends of a first support piece 61 are fitted into rail grooves of a receiving part 13, which is provided in the lower portion of the lower body 10 of the vacuum sealer, thus allowing the first support piece to be retracted into and extended from the lower body, so that and a support-piece receiving part 61*a* having rail grooves is provided in the first support piece 61 to receive a second support piece 63. Preferably, stoppers (not shown) are provided on the rear ends of the support pieces 61 and 63, the receiving part 13 of the lower body 10, and the support-piece receiving part 61*a* of the first support piece, thus preventing each support piece from extending outwards beyond a predetermined range. In order to prevent the first and second support pieces from being undesirably moved outwards by slight impacts when the first support piece is received in the receiving part of the lower body, and the second support piece is received in the support-piece receiving part of the first support piece, locking members are provided on the first and second support pieces (but, when a user catches and pulls out each support piece, the support piece must be easily pulled out).

The support means 160 of FIG. 10 is constructed to have the partial drawer-partial foldable structure. That is, a first support piece 161 is received in the receiving part 13 of the lower body 10 of the vacuum sealer V using rail grooves in the manner of a drawer. Conversely, a pivot pin (not shown) of a second support piece 163 is fitted into a pin hole (not shown) formed in the front end of the first support piece 161, so that the second support piece can be folded and unfolded. A receiving part 161*a* is provided on the front of the upper surface of the first support piece 161 to correspond to the shape of the second support piece. Thereby, when the second support piece 163 is folded over the first support piece, it is in the same plane as the upper surface of the first support piece. Preferably, the support means 160 of FIG. 10 is provided with a stopper and a locking member so as to prevent the undesirable removal of the support pieces from the lower body. Especially, when the second support piece is unfolded, the rear end of the second support piece 163 overlaps the front end of the first support piece 161 to some extent, so that the second support piece is not bent downwards, and is at the same level as the first support piece. Such a support means may be variously changed. The multistage structure may be variously changed.

Figure 7:
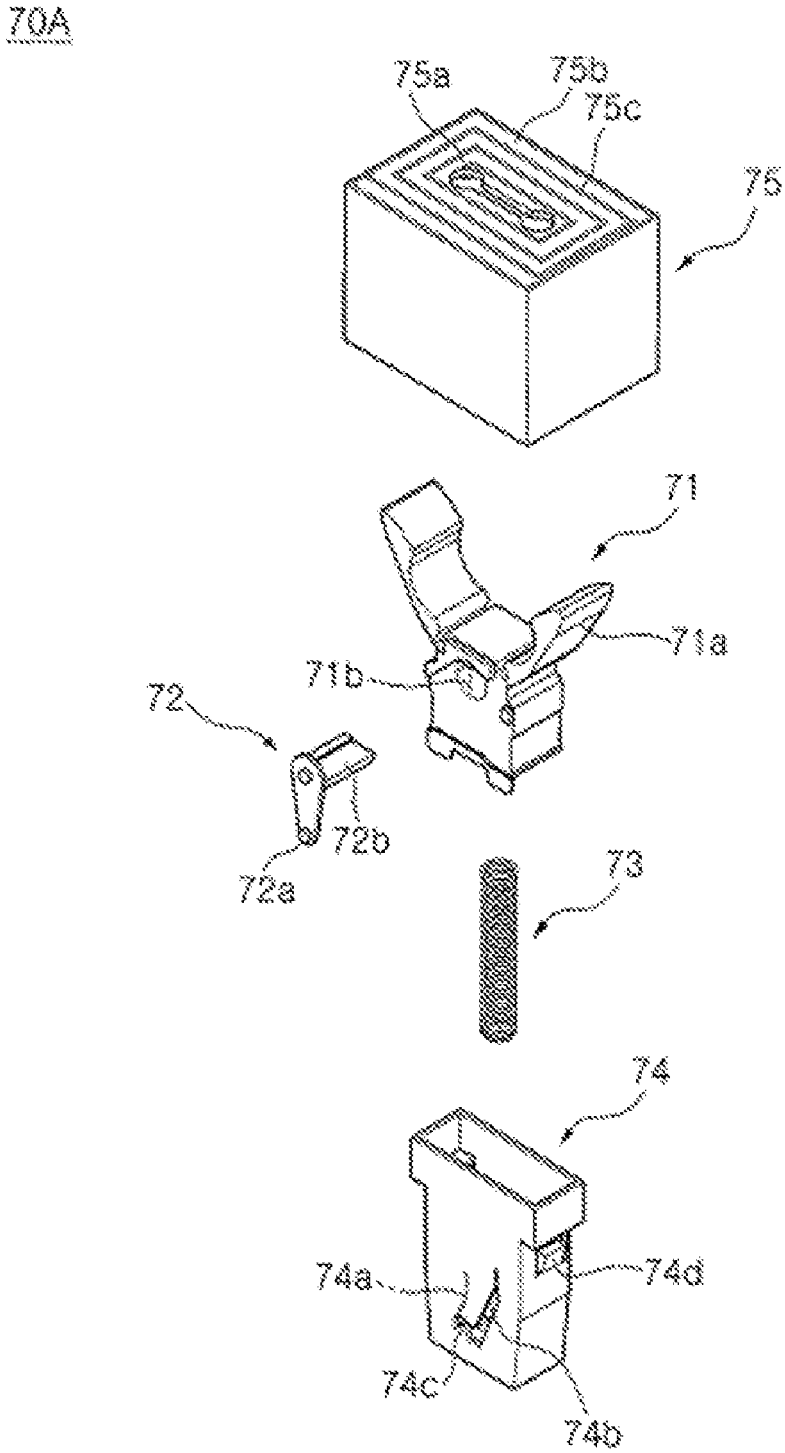
FIG. 7 is an exploded perspective view showing a one-touch type locking means.

As shown in FIGS. 2 and 7, the general construction of a one-touch type locking means L, which is the important part of the invention, remains the same as Korean Patent Laid-Open Publication No. 1989-0006128, which was published on May 18, 1989 and is entitled 「Push Latch Device」, and Korean U.M. Registration No. 0106852, which was registered on Jul. 9, 1997 and is entitled 「Door Locking Device」. However, the one-touch type locking means of this invention is improved to have high operational reliability. The locking means L includes locking units 70A which are provided on the lower body 10, and locking bars 70B which are provided on the upper body 20. The position of the locking units may be exchanged with that of the locking bars. Since the sealing members 55 and 56 provided around the vacuum channels C and C' are made of a material having elasticity, such as a polyurethane foam material, the sealing members may contract when pressed. Thus, when the upper body 20 contacts the lower body 10 and hook members 71 of the locking units 70A engage with locking ends 70B' of the locking bars 70B, the sealing members 55 and 56 are pressed and contract, so that the sealing members reliably contact each other, and thus the vacuum space R is reliably isolated from the exterior. The operation of the locking means will be described below in detail. When the hook members 71 of the locking units 70A engage with the locking ends 70B' of the locking bars 70B, so that the lower body 10 contacts the upper body 20, that is, the sealing members 55 and 56 contact each other, and the upper body 10 is pressed against the lower body 20, the sealing members 55 and 56 contract and the locking ends 70B' of the locking bars 70B, caught by the elastic hook parts 71*a*, press the hook members 71. Thereby, a guide lever 72, which is inserted into an insert hole 71*b* of each hook member 71 and is elastically biased by a compressed spring 73, moves downwards, as the hook member 71 moves downwards. At this time, a locking protrusion 72*a* of the guide lever 72 is removed from a stopping hole 74*c* of a casing 74 and moves upwards along a unlocking guide slit 74*b*, so that each hook member 71 moves upwards. Each elastic hook part 71*a* is released from the casing 74 and is opened. Consequently, the locking end 70B' of each locking bar 70B is released from the corresponding elastic hook part 71*a*, so that the vacuum sealer is unlocked.

Further, stoppers 74*d* are provided on both sides of the casing 74 of each locking unit 70A, so that the locking unit 70A is press-fitted into a respective mounting part 15 of the lower body 10, using the stoppers and locking pieces (not shown) which are provided on the mounting part. The elastic hook part 71*a* of each hook member 71, which is installed in each casing 74 to be elastically biased by the spring 73, engages with or disengages from the locking end 70B' of the corresponding locking bar 70B. An insert protrusion 72*b* of the guide lever is inserted into the insert hole 71*b* of each elastic hook part so that the guide lever 72 is pivotably secured to the hook member. When the insert protrusion 72*b* is pressed by the upper end of the spring 73, the locking protrusion 72*a* of the guide lever 72 stays on the right side of the casing 74 of FIG. 7, due to the characteristic shapes of the insert protrusion 72*b* and the insert hole 71*b* of the hook member. Thus, in the state where the spring 73 extends so that the elastic hook part 71*a* of each hook member 71 moves away from the casing 74 and disengages from the locking bar 70B, when the upper body 20 is pressed against the lower body 10, each locking bar 70B contacts a corresponding hook member 71 and moves downwards. At this time, the locking protrusion 72*a* of the guide lever 72 moves downwards along a locking guide rail 74*a*, which is diagonally provided on the inner surface of the casing 74, and reaches the stopping hole 74*c*, which is formed in the center of the casing 74. Thereby, the locking protrusion protrudes out of the stopping hole to be locked thereto, and the locking bar 70B' engages with the hook elastic part 71*a*. At this time, the upper body 20 contacts the lower body 10, and the vacuum space R is formed by the sealing members 55 and 56.

In such a state, when the upper body is pressed again, the sealing members 55 and 56 contract, and each locking bar 70B presses a corresponding hook member 71. At this time, the guide lever 72 is released from the upper edge of the stopping hole 74*c*, so that the guide lever moves rightwards again because of the operation of the spring 73 and the construction of the insert hole 71*b* of the hook member 71 and the insert protrusion 72*b* of the guide lever 72. When force is removed from the upper body 20, the locking protrusion 72*a* of the guide lever 72 moves upwards along the unlocking guide slit 74*b* of the casing 74 due to the elasticity of the spring 73, so that the elastic hook part 71*a* of each hook member 71 disengages from the locking end 70B' of the corresponding locking bar 70B.

Referring to FIGS. 2 and 7, the locking means L further includes an outer covering 75 that prevents impurities from entering each locking unit 70A. As shown in the drawings, the outer covering covers each mounting part 15 of the lower body 10. A dumbbell-shaped longitudinal insert hole 75*a* is formed in the upper surface of the outer covering so that the locking end 70B' of each locking bar 70B is inserted into the insert hole. Thin parts 75*b* and thick parts 75*c* are alternately provided on the upper surface of the outer covering 75, thus providing proper elasticity. Such a construction allows the longitudinal insert hole 75*a* of the outer covering to have as small an area as possible, thus maximally preventing the ingress of impurities, and prevents the upper surface of the outer covering from being caught in the hook member 71 due to the locking end 70B' of the locking bar, even when the outer surface of the locking bar 70B contacts a portion around the longitudinal insert hole 75*a* of the outer covering.

Figure 8:
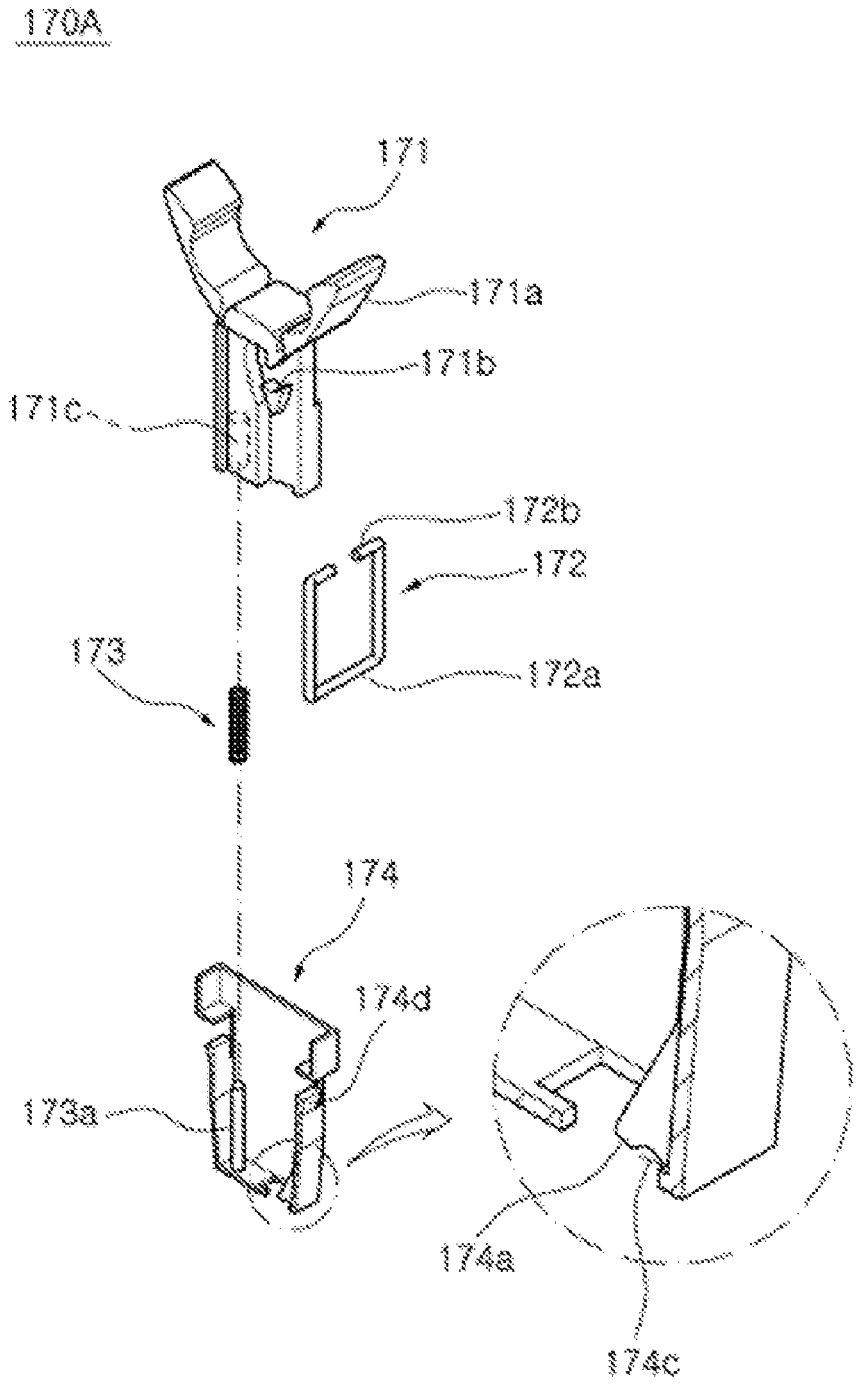
FIG. 8 is an exploded perspective view showing a one-touch type locking means, which is different from that of FIG. 7.

Such a one-touch type locking means may be replaced by various known locking means. For example, FIG. 8 shows a locking unit 170A, which overcomes the low durability of the guide lever 72 of the locking unit 70A of FIG. 7, especially, the low durability of the locking protrusion 72*a*. The locking unit 170A includes a hook member 171, a guide lever 172, a spring 173, and a casing 174. The guide lever 172 is manufactured by bending a linear member having elasticity. A latch 172*a* is provided on the lower portion of the guide lever, and pivot shafts 172*b* are provided on the upper portion of the guide lever. An elastic hook part 171*a* of the hook member 171 is the same as that of FIG. 7. However, since the locking unit of FIG. 8 has a modified guide lever, shaft seating parts 171*b* are provided on both sides of the hook member so that the pivot shafts 172*b* of the guide lever 172 are supported by the shaft seating parts. The spring 173 is inserted into an insert groove 171*c* which is formed in the left side of the lower portion of the hook member 171, and a support protrusion 173*a* is provided in the casing 174, which is partially cut away in the drawing, to support the spring 173. A locking-unlocking rail 174*a* for locking or unlocking the guide lever 172 corresponds to the lower surface of a protrusion which is provided on the right side of the inner wall of the casing 174 and has the shape of a wedge. A stopping groove 174*c* is provided on the right side of the rail 174*a*, and stoppers 174*d* are provided on both sides of the casing 174 to secure the locking unit 170A to each mounting part of the lower body.

The hook member 171 is positioned above the casing 174. Thus, when the hook member compresses the spring 173 and moves downwards while the hook member is not engaged with the locking bar, the elastic hook part 171*a* is closed by the casing, and the guide lever 172, which may pivot on the pivot shafts 172*b* seated on the shaft seating parts 171*b* of the hook member 171, moves downwards along the wedge-shaped protrusion provided on the inner wall of the casing. As the guide lever moves downwards, the guide lever gradually deviates from a straight line, moves to the left, and becomes inclined. When the guide lever reaches the starting point of the locking-unlocking rail 174*a*, which is provided at the lowermost portion of the protrusion, the guide lever is maximally inclined. The rail 174*a* is inclined. Thus, when the latch 172*a* of the guide lever moves further downwards to a position under the starting point of the rail, the guide lever is released from the wedge-shaped protrusion, and thus naturally pivots due to gravity, to be raised again. Thus, the guide lever 172 moves about the pivot shafts 172*b* to the right. At this time, due to inertia, the guide lever is not erected but moves further to the right to be positioned under the stopping groove 174*c*. When force is momentarily removed from the hook member 171 (the moment can be perceived because the sealing members 55 and 56 are not compressed any more), the spring 173 is extended, so that the latch 172*a* of the guide lever 172 is locked to the stopping groove 174*c*, and the elastic hook part 171*a* of the hook member engages with the locking end of the locking bar, and thus the vacuum sealer is locked. In such a state, when the upper body 20 of the vacuum sealer, that is, each hook member 171, is pressed, the latch 172*a* of the guide lever 172 is dislodged from the stopping groove 174*c*, and the guide lever is erected again due to gravity and is positioned under the locking-unlocking rail 174*a*. When the force is removed from the hook member, the hook member 171 is moved upwards by the elasticity of the spring 173. Thereby, the latch 172*a* of the guide lever 172 slides along the inclined surface of the rail 174*a* and is removed from the wedge-shaped protrusion. When the hook member moves upwards relative to the casing 174, so that the elastic hook part 171*a* is opened, the locking unit is disengaged from the locking end of the locking bar. Of course, the outer covering shown in FIG. 7 may be applied to the locking unit of FIG. 8.

Figure 18:
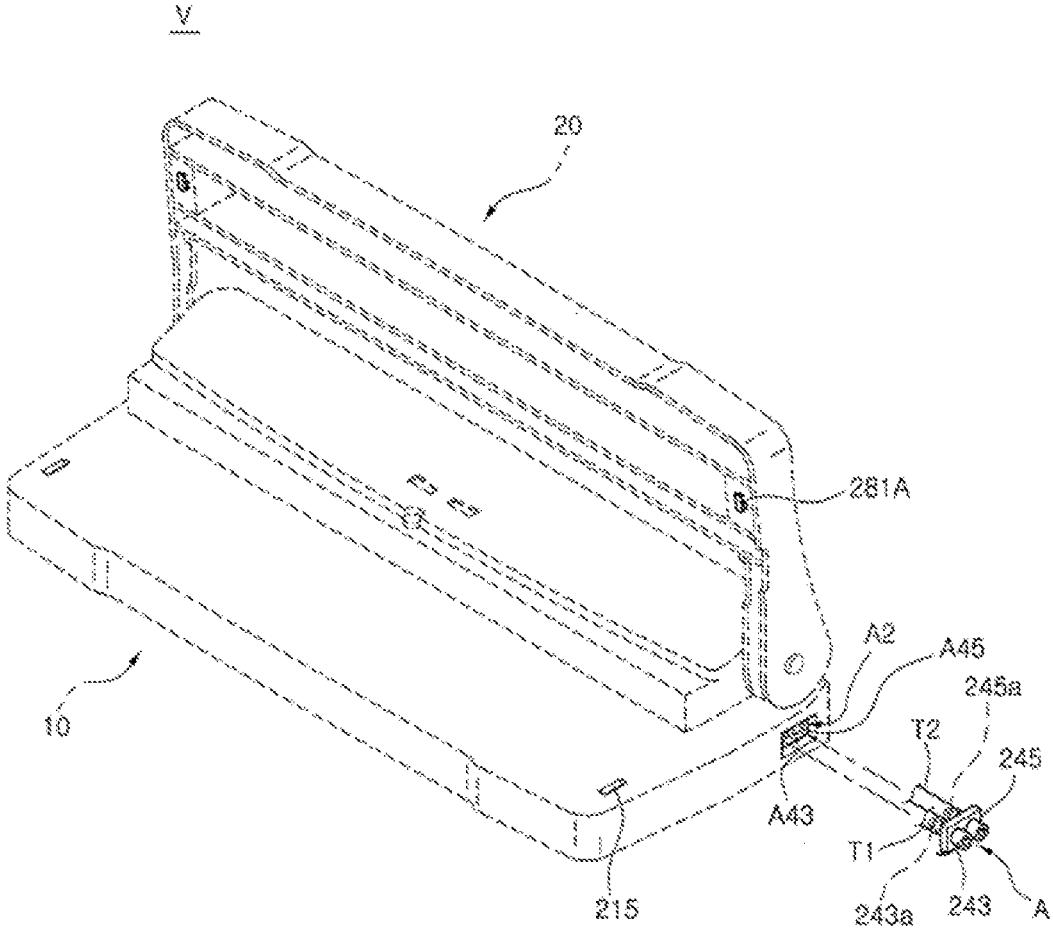
Figure 19:
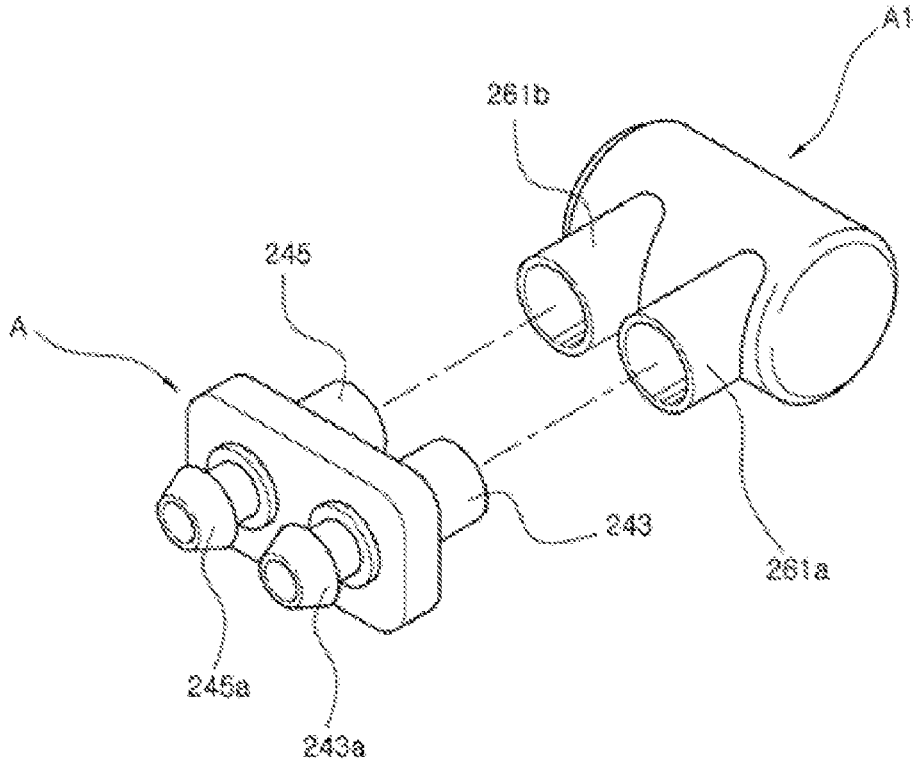
Figure 20:
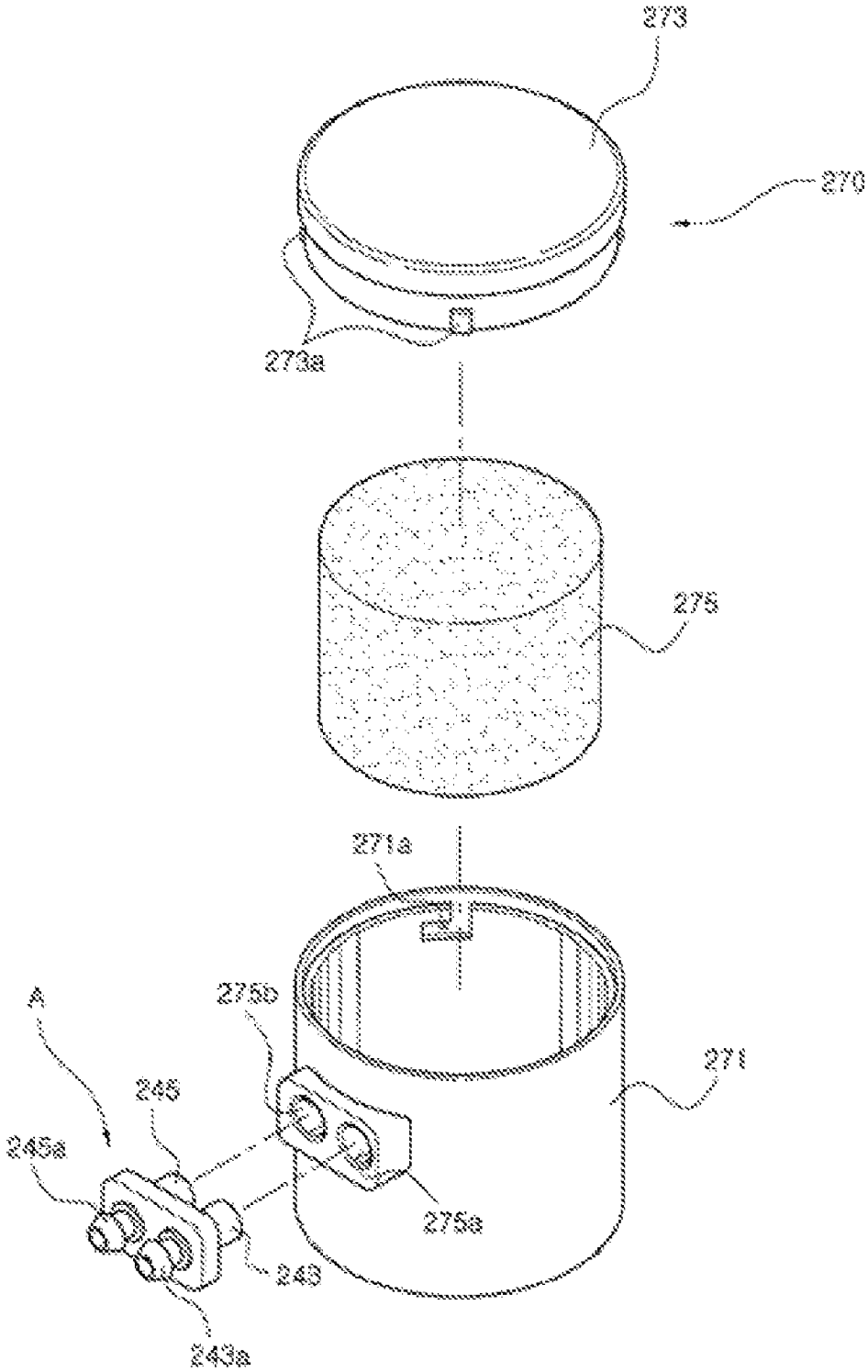

Next, a vacuum release means F and a silencer S, which are provided on the vacuum sealer V according to the present invention, will be described with reference to FIGS. 11 to 13. According to the present invention, a filtering means, which is shown in FIGS. 18 and 20 and functions to prevent moisture and impurities discharged from the product contained in the vacuum bag from entering the pump, may be provided on a tube which couples the suction hole of the vacuum space with the vacuum pump. Reference character A of FIG. 12 denotes an adapter for mounting the filtering means, and reference character A1 denotes a coupling member which directly couples the exhaust hole 51A formed in the channel C of the lower body 10 with the pump, and, more particularly, the nozzle 41*a* provided on the lower surface of the communication hole 11A of the holding part 11 with the pump 40, when a general vacuum creating operation is conducted without using the filtering means. That is, the adapter A allows the filtering means, which prevents liquid impurities, discharged from the product contained in the vacuum bag during the vacuum packing operation from flowing through the suction hole 41 to the pump 40, to be applied to the vacuum sealer. Further, when it is not necessary to use the filtering means, the adapter allows the coupling member A1, which directly couples the exhaust hole 51A with the suction nozzle 43*a* of the pump 40, to be directly connected to the vacuum sealer after the filtering means has been removed from the vacuum sealer. One of the nozzles of the adapter A, which are provided in the lower body 10, is connected to a first tube T1, so that the nozzle communicates with the exhaust hole 51A formed in the upper portion of the lower body 10 (as shown in the drawings, the nozzle 41*a* provided on the lower surface of the communication hole 11A of the holding part 11, which is in close contact with and communicates with the first tube T1 and the exhaust hole 51A, is coupled to the first tube T1). The other nozzle of the adapter is coupled to a second tube T2. The second tube is coupled to other parts, such as the pump 40. As shown in FIG. 14B, the second tube is provided with a "T"-shaped fitting so as to simplify the arrangement between portions T2 and T2' of the second tube. A first branch pipe L1 of the T-shaped fitting LT is coupled to the second tube T2, a second branch pipe L2 is coupled to the second tube T2', and a third branch pipe L3 is coupled to a fourth tube T4 which is connected to a pressure sensor PS that measures the pressure in the vacuum space R. Each of the branch pipes L1, L2, and L3 is tapered toward one end thereof so that the sectional area is reduced toward the end. Such a shape allows the fitting to be easily coupled to an associated tube, ensures airtightness, and prevents the undesirable removal of the fitting. The portion La that has the largest sectional area in the tapered end is larger than the inner diameter of the soft tube when no external force is applied to the tube. The sectional area is sharply reduced from the portion La, thus providing a smaller portion Lb. Thus, the soft tube fitted over the fitting LT is expanded at the portion La and is contracted at the portion Lb, so that airtightness and reliable coupling are achieved.

Figure 12:
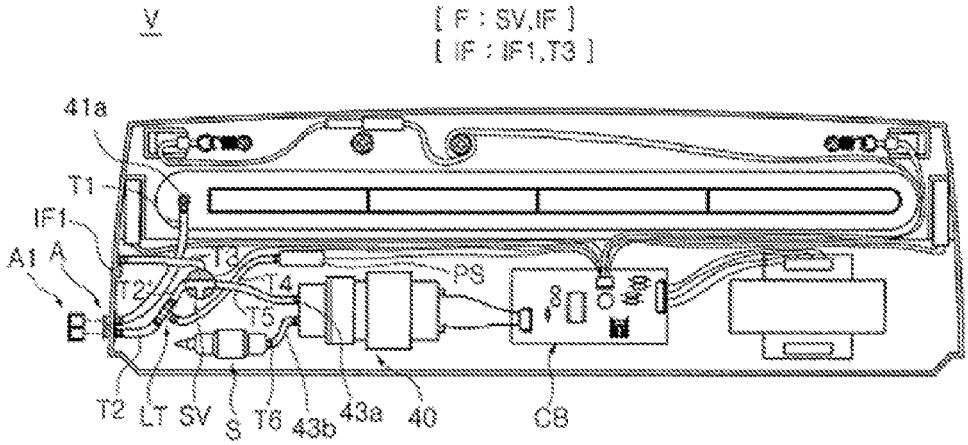
FIG. 12 is a bottom view schematically showing the interior of a vacuum sealer, according to the present invention, which is different from that of FIG. 11.
Figure 13:
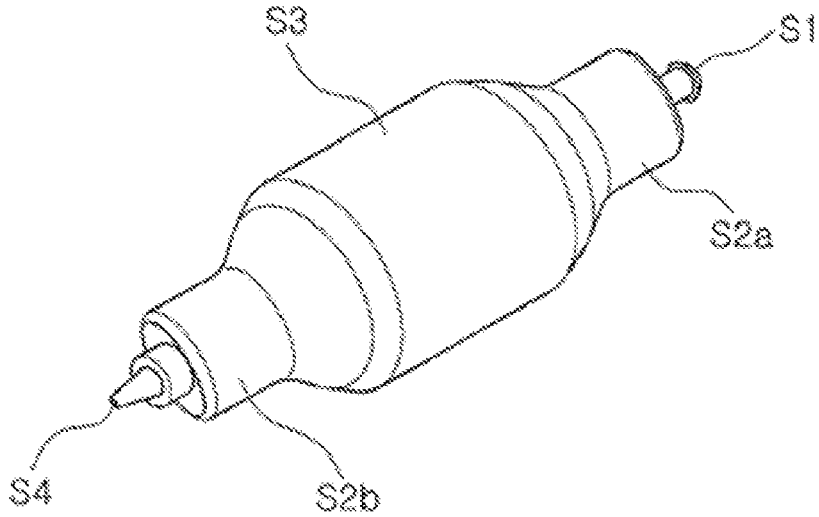
FIG. 13 is a perspective view showing a silencer.
Figure 14:
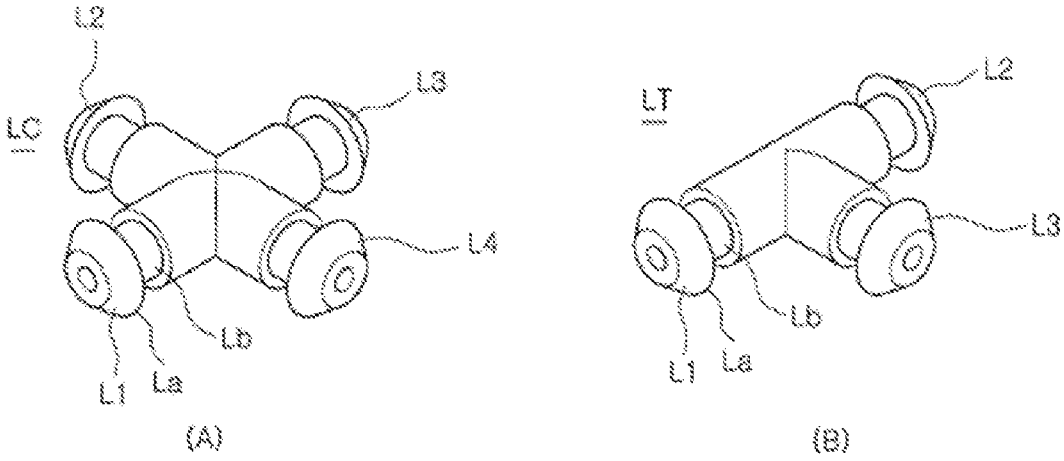
FIG. 14 is a perspective view showing cross-shaped and T-shaped fittings for tubes.

As shown in FIGS. 12 and 13, the silencer S has a connection part S which is connected through a sixth tube T6 to an exhaust nozzle 43*b* of the vacuum pump 40. The silencer has the shape of a pot, both sides of which are symmetrical with respect to each other. The middle portion of the silencer bulges, thus providing an enlarged part S3. Narrow parts S2*a* and S2*b* are provided on opposite sides of the enlarged part S3. One S2*a* of the narrow parts is coupled to a connection part S1, while the other narrow part S2*b* is coupled to an outlet port S4.

Figure 15:
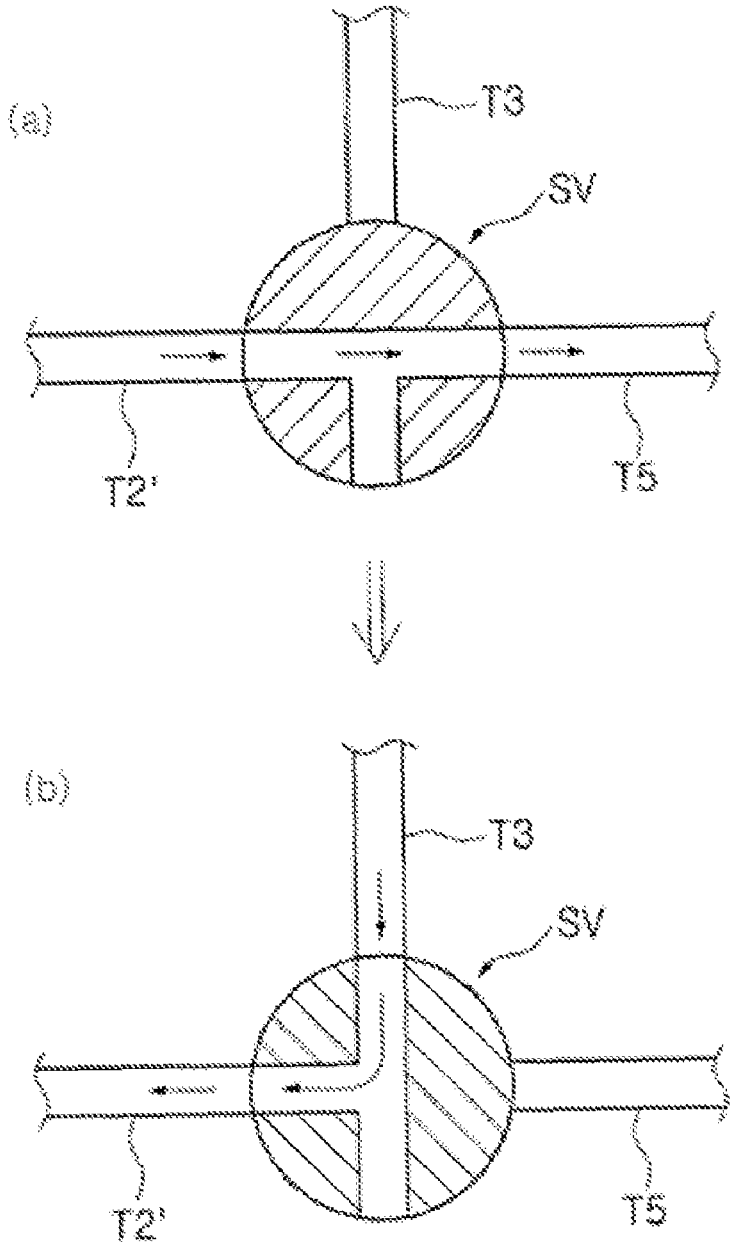
FIG. 15 is a concept view showing a solenoid valve constituting a vacuum release means.

As shown in FIGS. 12 and 15, the suction nozzle 43*a* of the vacuum pump 40 is coupled to the solenoid valve (SV) comprising the automatic vacuum release means F, which is one of the important parts of the present invention (the vacuum release means includes the solenoid valve and an air inlet part IF). The solenoid valve is a three-way valve. One of three coupling parts is coupled to a fifth tube T5 so as to connect the solenoid valve to the suction nozzle 43*a* of the vacuum pump 40. Another coupling part is coupled to the second coupling tube T2', so that the solenoid valve coupled to the second coupling tube T2' is sequentially coupled to the fitting LT, the second tube T2, the adapter A, the first tube T1, the nozzle 41*a*, the communication hole 11A formed in the channel C of the lower body 10, and the exhaust hole 51A, and is thus coupled to the vacuum space R. The other coupling part is coupled to the third tube T3, forming the air inlet part IF of the vacuum release means F. As shown in FIG. 12, the third tube is coupled to an air inlet hole 1F1 of the air inlet part 1F. The air inlet hole of the drawing is formed in the lower body. However, the air inlet hole may be a hole which is formed in a housing of the solenoid valve.

The vacuum sealer V of FIG. 12 has the adapter A so that the filtering means can be applied to the vacuum sealer. Conversely, the vacuum sealer V of FIGS. 1 and 2 has no adapter A. The interior of the vacuum sealer V of FIG. 1 is schematically shown in FIG. 11. The vacuum sealer of FIG. 11 is different from that of FIG. 12 in that it does not have the adapter A or the coupling member A1 for applying the adapter A to the vacuum sealer. Thereby, the nozzle 41*a*, communicating with the exhaust hole 51A though the communication hole 11A, is coupled through the tube T1 to a cross-shaped fitting LC, which is shown in FIG. 13A. Among four branch pipes of the fitting LC, a first branch pipe L1 is coupled through the tube T1 to the nozzle 41*a*, and a second branch pipe L2 is coupled through the tube T2 to the solenoid valve SV, which releases the vacuum through the supply of external air. The solenoid valve SV is coupled through the tube T3 to the air inlet hole 1F1 of the vacuum release means F. A third branch pipe L3 is coupled to the fourth tube T4, which is connected to the pressure sensor PS to measure the pressure in the vacuum space R. A fourth branch pipe L4 is coupled to the fifth tube T5, which is connected to the suction nozzle 43*a* of the pump 40.

The operation of the solenoid valve SV comprising the vacuum release means F will be described with reference to the vacuum sealer of FIG. 12. The solenoid valve is operated by a control unit, especially a control board (CB) on which microprocessor chips are mounted, as shown in the drawings. That is, as shown in FIGS. 1 and 9, the vacuum bag B containing the product P is placed on the support means 60, and the end of the vacuum bag B is placed in the vacuum channel C of the lower body 10. In such a state, the upper body 20 is moved downwards and the engagement of the upper body with the lower body is maintained by the one-touch type locking means L, thus forming the vacuum space R. When the actuating buttons 40A and 40B provided on the upper surface of the lower body 10 are pressed by the pressure protrusions 21 of the upper body 20 (although not shown in the drawings, a user may press the actuating buttons to manually operate the vacuum pump, or the vacuum pump may be automatically operated by sensing pressure applied by the upper body), so that an actuating signal is applied to the vacuum pump 40, the coupling course of the solenoid valve SV is checked using the microprocessor of the control board CB. If the solenoid valve makes the second tube T2' and the fifth tube T5 communicate with each other, as shown in FIG. 15A, the coupling course is used without change. Meanwhile, if the solenoid valve makes the second tube T2' and the third tube T3 communicate with each other, as shown in FIG. 15B, the coupling course is changed to the coupling course of FIG. 15A. In such a state, when the vacuum pump 40 is operated, vacuum pressure acts on the suction nozzle 43*a*, the fifth tube T5, the solenoid valve SV, the second tube T2', the fitting LT, the second tube T2, the adapter A, the first tube T1, the nozzle 41*a*, the communication hole 11A, the exhaust hole 51A, and the vacuum space R, so that air is exhausted from the vacuum bag B, and is discharged through the exhaust nozzle 43*b* of the vacuum pump 40 and the silencer 40. When the pressure value in the vacuum space R, detected by the pressure sensor, exceeds a reference value (alternatively, when the operating time of the vacuum pump exceeds a preset time), the microprocessor determines that the vacuum pump is to stop operating (or continue to operate). In such a state, the heater 30 is operated to heat and seal the end of the vacuum bag. It is determined whether the operating time of the heater has exceeded a preset time (alternatively, temperature is sensed, so that a predetermined temperature is maintained for a predetermined period of time), thus stopping the heater 30 (if the vacuum pump continues to operate, the pump is stopped). When a signal indicating the stoppage of the heater 30 is input, the microprocessor constituting the control unit commands that the coupling course of the solenoid valve SV be changed. Thereby, the third tube T3 forming the air inlet part 1F communicates with the second tube T2', so that external air flows through the air inlet hole 1F1, the third tube T3, the solenoid valve SV, the second tube T2', the fitting LT, the second tube T2, the adapter A, the first coupling tube T1, and the exhaust hole 51A, to the vacuum space R, and thus the vacuum is released. Hence, it is possible to more easily separate the upper body from the lower body.

As necessary, the exhaust hole for evacuating the vacuum space and the exhaust hole for creating a vacuum in the vacuum space may be formed separately. Further, a backup switch may be provided to turn on or off either or both of the vacuum pump 40 and the heater 30, thus increasing stability.

After a predetermined time (e.g.: 10 seconds) has passed since the vacuum was released, the course of the solenoid valve SV making the second tube T2' and the fifth tube T5 communicate with each other is input as an initial value to the microprocessor. Thereby, in such a state, the following vacuum packing operation is conducted. When the operating mode of the vacuum sealer is variously constructed, the operation of the solenoid valve SV or the operation of the vacuum release means F are preferably conducted in only the evacuation (using the vacuum pump)-heat and seal (using the heater) mode, but are not conducted in the heat and seal mode for heating and sealing the vacuum bag, or the evacuation mode for creating vacuum. The evacuation mode may be selected when a user desires to create a vacuum in an external vessel using a part such as a universal auxiliary connector for creating a vacuum disclosed in Korean Patent No. 0549682, which was filed by the applicant of the present invention, and was registered on Jan. 31, 2006.

Figure 16:
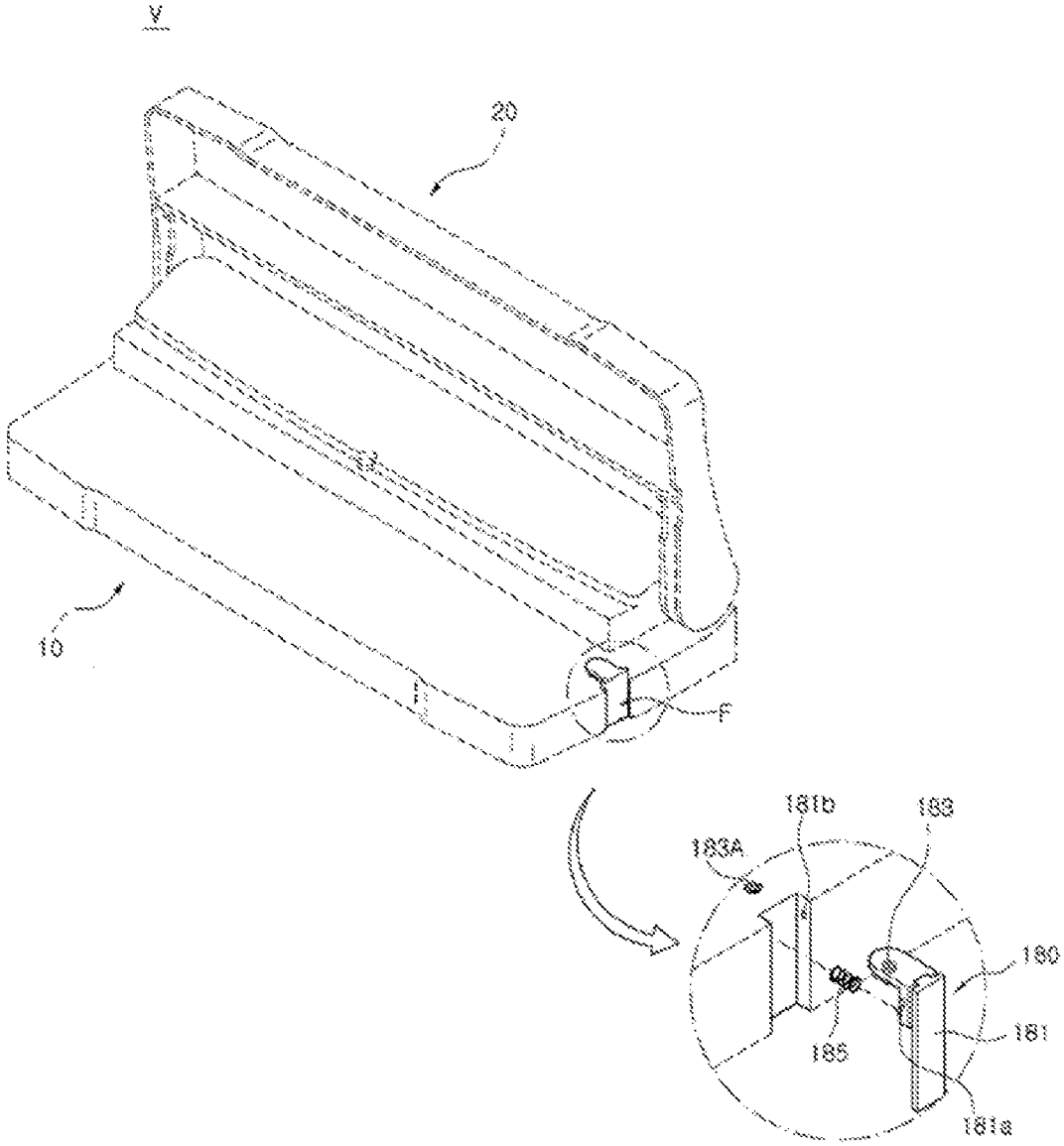
FIG. 16 is a perspective view showing a vacuum sealer having a manual vacuum release means.

FIG. 16 shows a vacuum sealer having a manual vacuum release means, unlike the vacuum sealer of FIGS. 2 and 11. For the clear description of the invention, components including the heater and the vacuum space creating member are omitted, but a schematic outline is shown in the drawing. The manual vacuum release means F includes a lever 181, an elastic member 185, a packing disc 183, and an air inlet hole 183A. The lever is provided with coupling protrusions 181*a*, which are inserted into coupling holes 181*b* formed in the side surface of the lower body 10. The elastic member elastically restores the lever 181 to its original position. The packing disc is provided to contact the lower body. The air inlet hole is opened or closed by the packing disc 183, and communicates with the tube for the vacuum pump. Alternatively, the vacuum release means F may be provided on the upper body 20. When the lower portion of the lever 181 is pressed after the vacuum creating operation, the lever rotates about the coupling protrusions 181*a*, so that the packing disc 183 opens the air inlet hole 183A. External air fed into the air inlet hole 183A flows through the tube into the vacuum space, thus releasing the vacuum. When the lever 181 is pressed for some time (e.g.: 2 to 4 seconds) and is then released, the lever is restored to its original state due to the elasticity of the elastic member 185, so that the packing disc 183 closes the air inlet hole 183A. As such, since the vacuum release means of the vacuum sealer V is provided on the side surface of the lower body, the danger of touching the vacuum release means by mistake and releasing the vacuum is prevented when the vacuum creating operation is conducted normally with the upper body 20 pressed.

FIGS. 17 to 22 show a vacuum sealer, in which a locking means and a vacuum release means are combined with each other and a filtering means is applied to the vacuum sealer. Referring to FIGS. 17 to 20 (FIG. 18 omits components including a heater and a vacuum space creating member, and represents a schematic outline, for clear depiction of the invention), the vacuum sealer V according to the present invention may use a filtering means 270 so as to filter liquid impurities leaking from the product contained in the vacuum bag, thus preventing the liquid impurities from flowing through the exhaust hole to the pump. When it is not necessary to use the filtering means 270, the filtering means is separated from the vacuum sealer, and then an adapter A is applied to the vacuum sealer so as to couple a coupling member A1, which directly couples the exhaust hole with the suction nozzle of the pump, to the vacuum sealer. A fitting nozzle A43, provided in a mounting part A2 which is provided on the right side of the lower body 10, is coupled to the nozzle 41*a* of the lower body 10 through the first tube T1, as shown in FIG. 11. A fitting part A45 of the mounting part A2 is coupled through the second tube T2 to the pump, as shown in FIG. 12. The adapter A, having protrusions 243*a* and 245*a* which are fitted into the fitting parts A43 and A45 of the mounting part A2, has an inlet port 243 and an outlet port 245 opposite the protrusions 243*a* and 245*a*. At normal times, as shown in FIGS. 16 and 18, the exhaust hole is coupled to the pump using the coupling member A1 having protrusions 261*a* and 261*b* which are fitted over the inlet port 243 and the outlet port 245. When the filtering means is used to filter the liquid impurities, as shown in FIG. 20, the coupling member A1 is separated from the adapter, and the filtering means 270 is coupled to the adapter A.

The filtering means may be installed in the lower body. However, in order to conveniently clean and replace the filtering means, as shown in FIG. 20, it is preferable that the filtering means 270 be a separable part. The filtering means 270 includes a housing 271, a filter 275, and a lid 273. The housing has holes 275*a* and 275*b*, so that the inlet port 243 and the outlet port 245 of the adapter A are inserted into the holes. The filter is provided in the housing 271. The lid has fastening protrusions 273*a* which are fastened to fastening holes 271*a* of the housing 271. Such a filtering means can be easily cleaned and replaced with another one, in addition to reliably preventing liquid impurities, discharged from the product contained in the vacuum bag, from entering the vacuum pump.

Figure 21:
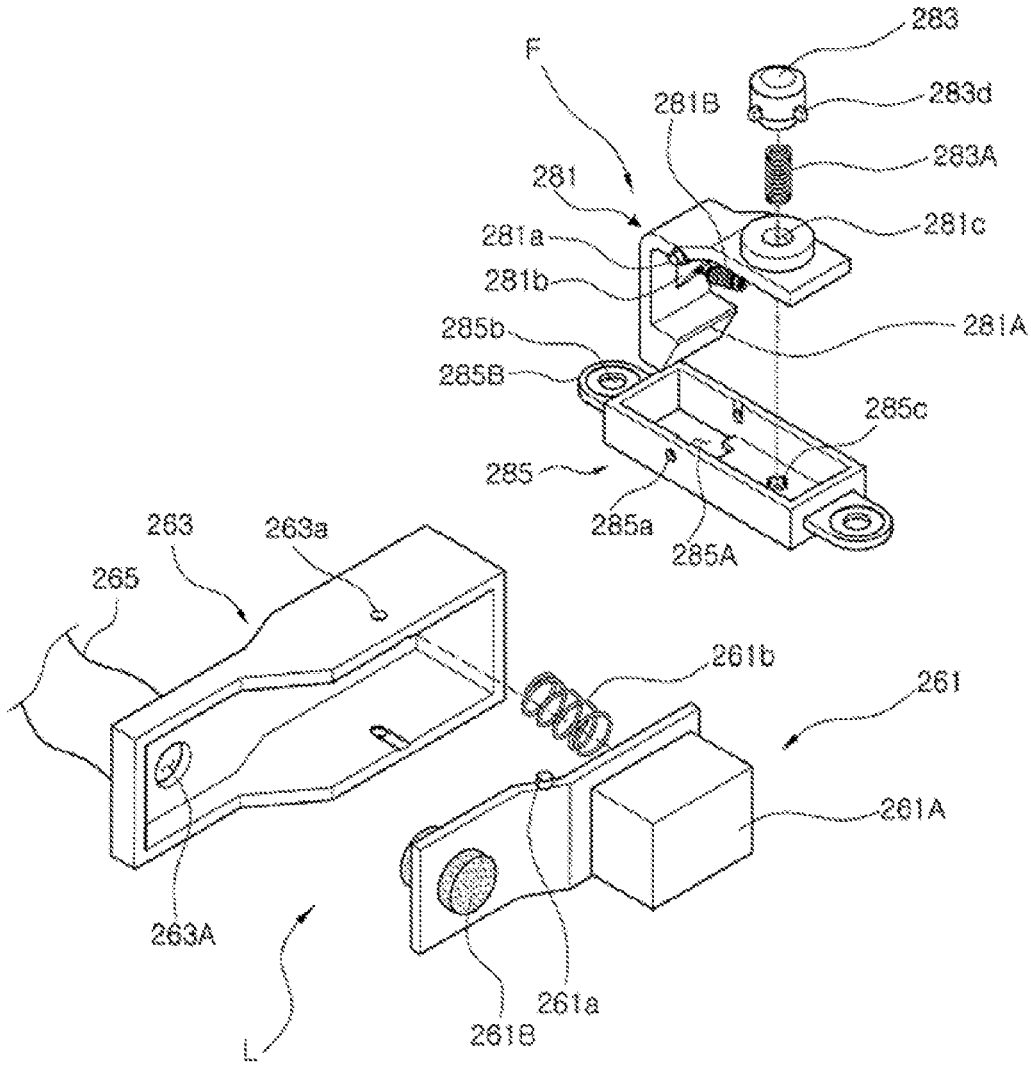

The vacuum sealer V, which is constructed so that the locking means and the vacuum release means are operated in conjunction with each other, will be described with reference to FIGS. 17, 18, 21, and 22. The locking means L of the vacuum sealer V, which is shown in the drawings, maintains the engaged state when the upper body 20 rotates about a hinge and engages with the lower body 10. The vacuum release means F is provided with a lever 261 which is pressed by an end of a hook 281A of a lever 281 of the locking means L. The locking means L eliminates the need to continuously press the upper body during the sealing operation of the vacuum bag, and includes the lever 281, a housing 285, and a button 283. The housing 285 has on both ends thereof brackets 285B, each having a fastening hole 285*b*, so that the locking means L is mounted to the upper body 20 of the vacuum sealer V using the brackets. The housing has an insert opening 285A such that the hook 281A of the lever 281 is inserted into the insert opening and is exposed to the outside of the insert opening. The lever 281 is bent downwards at a portion having the hook 281A, and a spring seating hole 281*c* is formed in the upper surface of the lever so that a support spring 283A for elastically supporting the button 283 is inserted into the spring seating hole and is locked to a spring locking protrusion 283*c*. Further, the lever 281 has on both sides thereof locking protrusions 281*a*, which are fitted into locking holes 285*a* of the housing 285 to serve as a rotating shaft. A restoring spring 281B is provided to couple a mounting piece 281*b* of the lever 281 mounted to the upper body 20 with a mounting protrusion 285*d* provided on the bottom of the housing 285, thus providing restoring force to the lever. Referring to FIG. 21, the hook 281A of the lever 281 passes through a slot 215 which is formed in the upper portion of the lower body 10, and is locked to the inner wall of the lower body. Further, the button 283 is exposed to the outside of the upper body 10 so as to press the lever 281. Stopping protrusions 283*a* are provided on the lower portion of the button.

Figure 17:
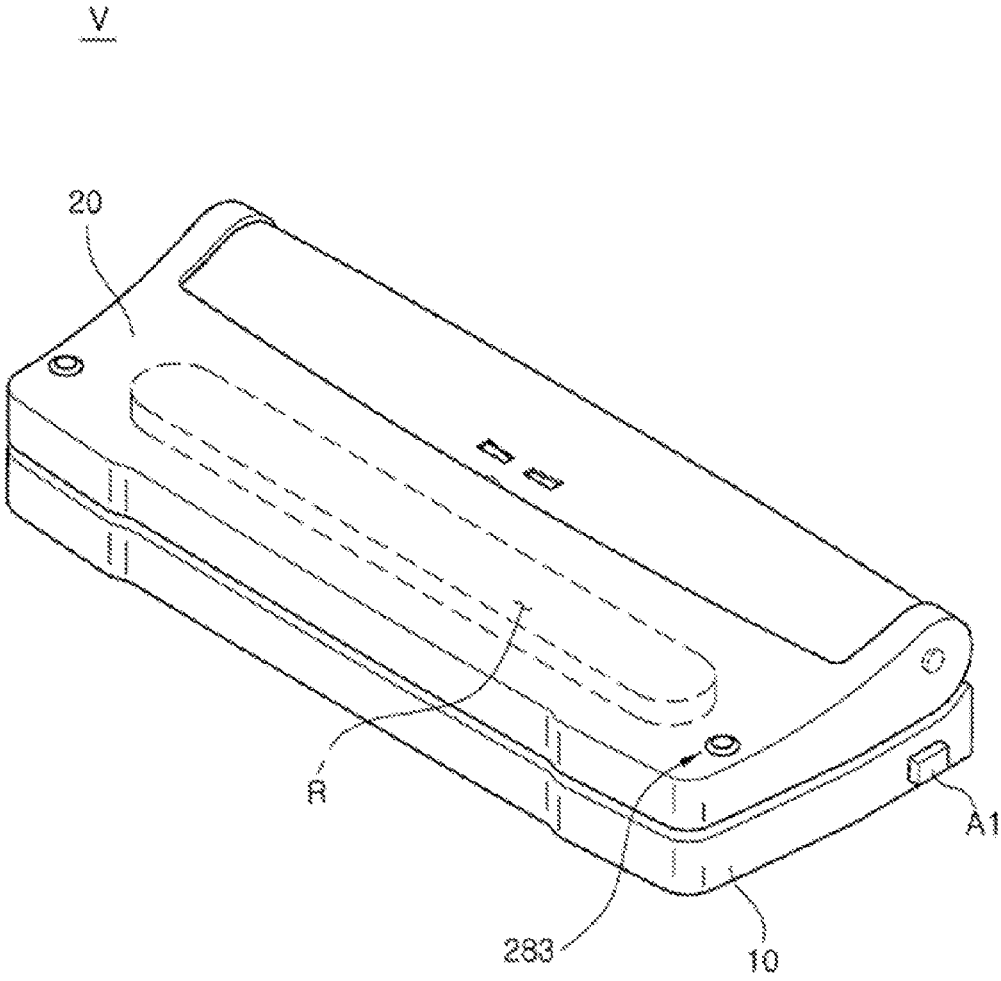
FIGS. 17 to 22 are views showing a vacuum sealer, in which a locking means and a vacuum release means are combined with each other, and a filtering means is applied to the vacuum sealer.
Figure 22:
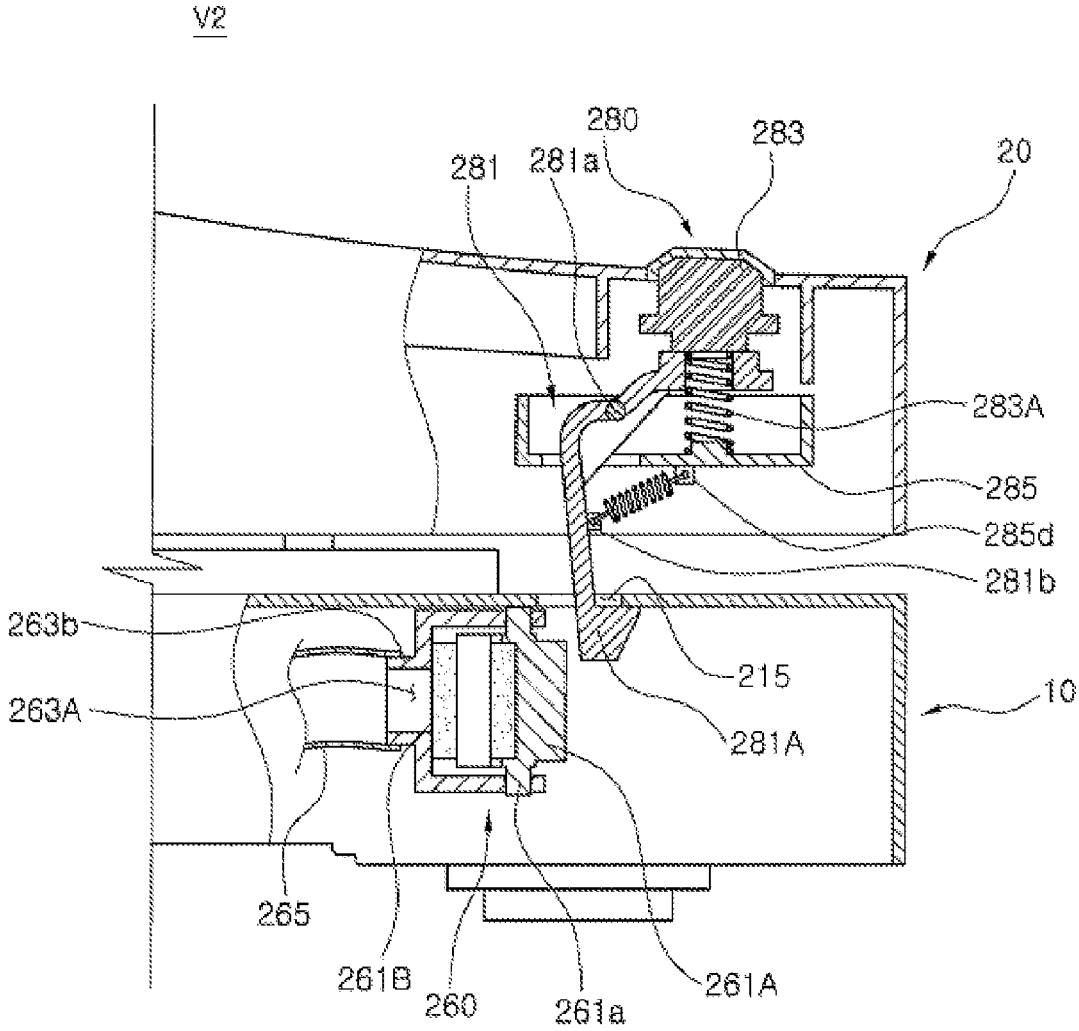

Hereinafter, the relationship between the locking means and the vacuum release means will be described. As shown in FIG. 17, the buttons 283 are provided on both sides of the upper portion of the upper body 20 in such a way as to be exposed to the outside. As shown in FIG. 18, the hooks 281A are provided on both sides of the lower portion of the upper body 20 in such a way as to be exposed to the outside. The slots 215 are formed in the upper surface of the lower body 10 so that the hooks 281A are locked to the slots. The vacuum release means F, which is operated in conjunction with the locking means, functions to supply air to the vacuum space. As shown in FIGS. 21 and 22, the vacuum release means includes a housing 263 and the lever 261. The housing has a fitting protrusion 263*b*, over which a tube 265 coupling the exhaust hole with an air inlet hole 263A is fitted. The lever is provided with a packing disc 261B which opens or closes the air inlet hole 263A. The housing 263 is installed in the lower body 10. Holes 263*a* are formed in the housing so that the locking protrusions 261*a* of the lever 261 serving as a rotating shaft are fitted into the holes. A support spring 261*b* is installed between the housing 263 and the lever 261 to provide elastic restoring force to the lever. When the lever 281 of the locking means L is pressed, a pressing part 261A of the lever 261 is pressed by the back surface of the hook 281A, so that the packing disc 261B opens the air inlet hole 263A of the housing 263, thus allowing air to flow into the vacuum space.

The connector according to the present invention will be described below.

Figure 23:
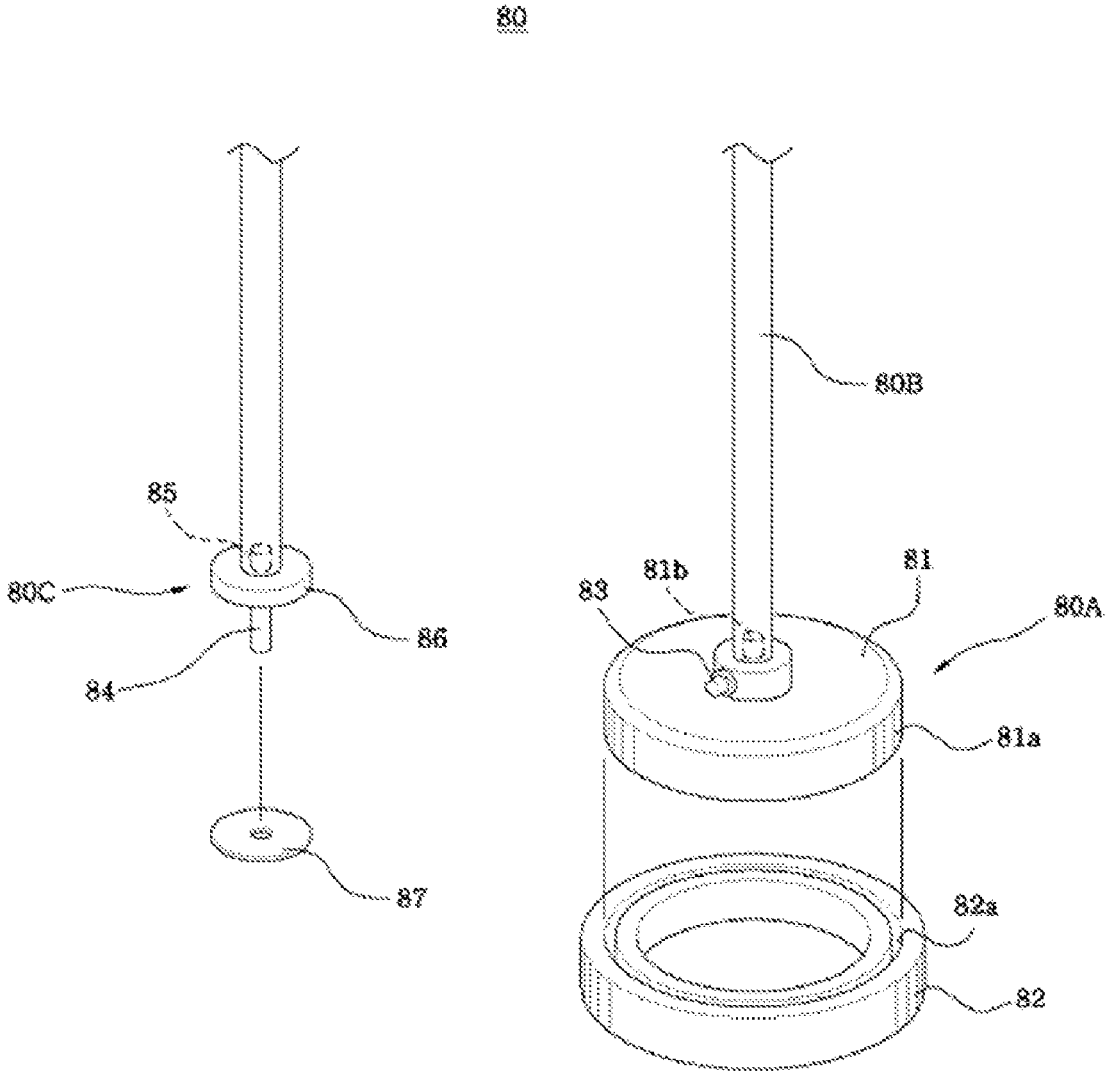
FIGS. 23 to 26 are views showing auxiliary connectors for creating a vacuum.

As shown in FIG. 23, an auxiliary connector 80 for creating a vacuum includes a suction part 80A, a coupling part 80C, and a tube 80B. The suction part is provided on the upper surface of a device to be evacuated, with a check valve provided on the device. The coupling part includes a fitting part which is fitted into the nozzle of the pump. The tube couples the suction part 80A with the coupling part 80C.

The suction part 80A has the shape of an inverted dish. Preferably, a packing ring 82 is provided on the edge 81*a* of a body 81 of the suction part 80A, thus allowing the suction part to be in closer contact with the device to be evacuated. The packing ring 82 has an annular groove 82*a*, so that the edge 81*a* of the body 81 of the suction part 80A is inserted into the annular groove. A coupling protrusion 81*b* is provided at the center on the body 81 and is coupled to one end of the tube 80B. Thus, the inner circumferential surface of the end of the tube 80B is coupled to the outer circumferential surface of the coupling protrusion 81*b* in a male-female-coupling method. The outer circumferential surface of the tube may be coupled to the inner circumferential surface of the protrusion in a male-female-coupling method. Various coupling methods are possible. Further, a means for reinforcing the coupling, such as a fastening band, may be provided.

It is preferable that the tube 80B be made of a flexible synthetic resin material.

Further, the coupling part 80C is coupled to the other end of the tube 80B via a coupling protrusion 85, and functions to couple the connector 80 to a pump nozzle 241. The inner circumferential surface of the end of the tube 80B is coupled to the outer circumferential surface of the coupling protrusion 85 in a male-female-coupling method. The coupling method may be variously changed.

The coupling part 80C is characterized in that the fitting part 84 is easily fitted into the nozzle 51*a* of the vacuum sealer (see, FIG. 3). To this end, the outer diameter of the fitting part 84 must be smaller than the inner diameter of the nozzle 51*a*.

Referring to FIG. 23, if the outer diameter of the fitting part 84 of the coupling part 80C is smaller than the inner diameter of the nozzle of the pump, a means for preventing the inflow of air through a junction between the fitting part 84 and the nozzle when vacuum pressure is applied to the internal passage of the connector by the pump is required. As shown in FIG. 23, a contact part 86 is used as a sealing means for preventing the inflow of air. The contact part is radially provided on the fitting part 84. Preferably, the diameter of the contact part 86 is larger than the outer diameter of the nozzle. Further, it is preferable that a gasket 87 be provided between the contact part 86 and the upper surface of the nozzle to improve airtightness.

This fitting part 84 of the coupling part 80C allows the connector to be easily coupled to pump nozzles having various inner diameter dimensions. Further, the contact part 86 and the gasket 87 reliably ensure airtightness.

Further, when the connector 80 connects the pump to the device to be evacuated and then the pump is operated, the contact part 86, substantially the gasket 87, is pressed against the outer surface of the upper portion of the nozzle by the suction force acting on the nozzle. Thus, during the vacuumizing operation, the connector 80 is not easily separated from the nozzle.

Figure 24:
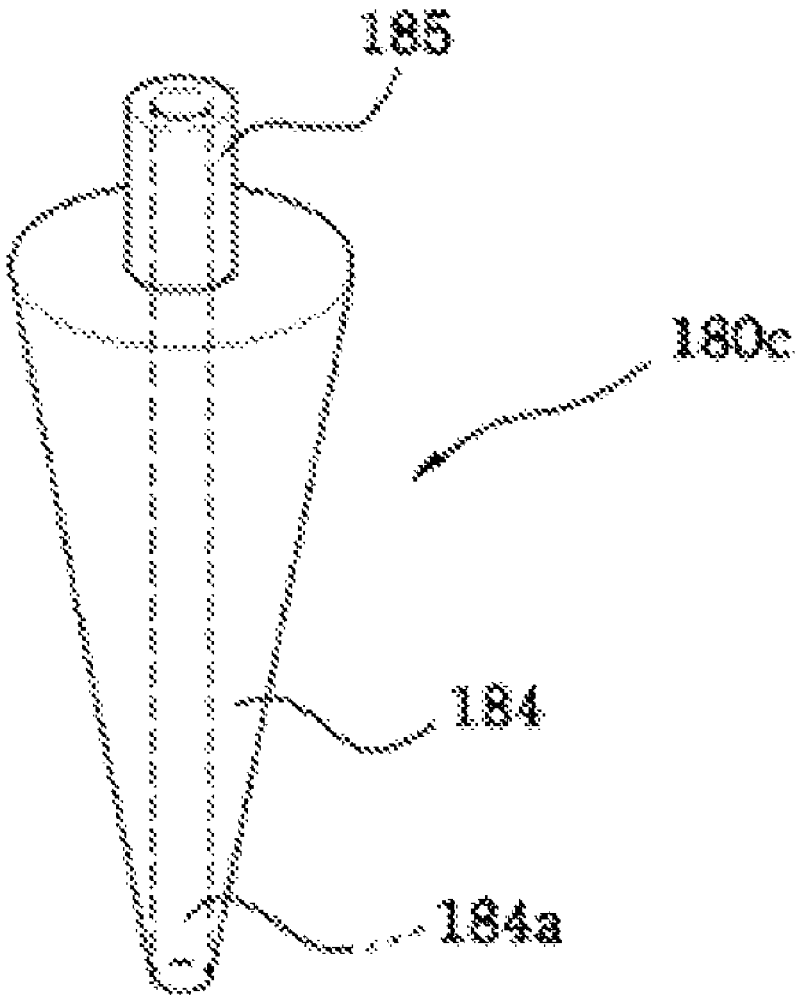

FIG. 24 shows another coupling part 180C for the connector. The coupling part 180C has the shape of a truncated cone which is wide at an upper position and is narrow at a lower position. A path 184*a* is defined in a central axis of the coupling part 180C. A coupling protrusion 185 is provided on the enlarged portion of the coupling part 180C to be coupled to one end of the tube in a male-female-coupling method. A fitting part 184 is provided on the lower portion of the protrusion 185.

A portion of the fitting part 184 which is opposite the coupling protrusion 185 has a pointed end. Preferably, the inclination angle of the fitting part 184 ranges from 83 degrees to 86 degrees. Thus, regardless of the inner diameter of the nozzle of the pump, the fitting part 184 can be inserted into the nozzle.

Further, the fitting part 184 of the coupling part 180C is shaped such that the upper portion of the fitting part is wide and the lower portion thereof is narrow. Thus, when the fitting part is fitted into the nozzle and the pump is operated to generate suction force, the fitting part 184 is pressed towards the nozzle, so that airtightness is ensured. Thereby, the fitting part 184 itself serves as a sealing means. In order to increase airtightness, the outer surface of the fitting part 184 is coated with rubber or a soft synthetic resin material. Preferably, the fitting part itself is made of a soft material.

Figure 25:
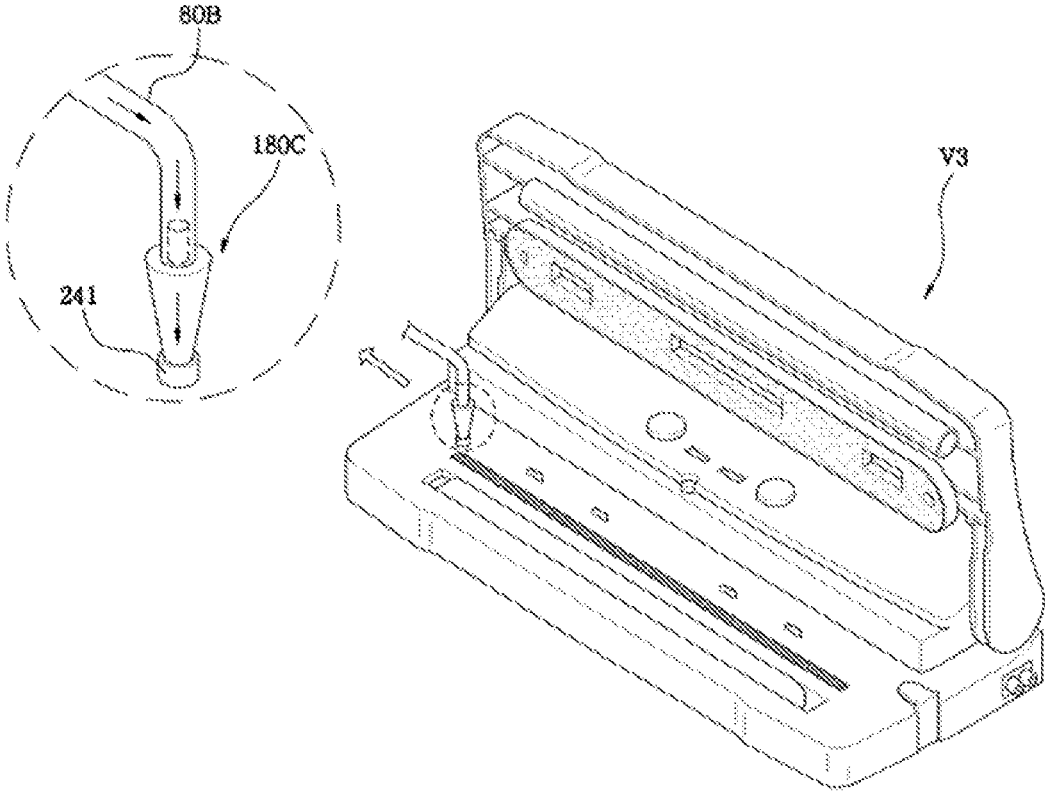

FIG. 25 shows the state where the coupling part 180C of the connector is fitted into the nozzle 51*a* of the vacuum sealer V3 (see the enlarged circle).

Figure 26:
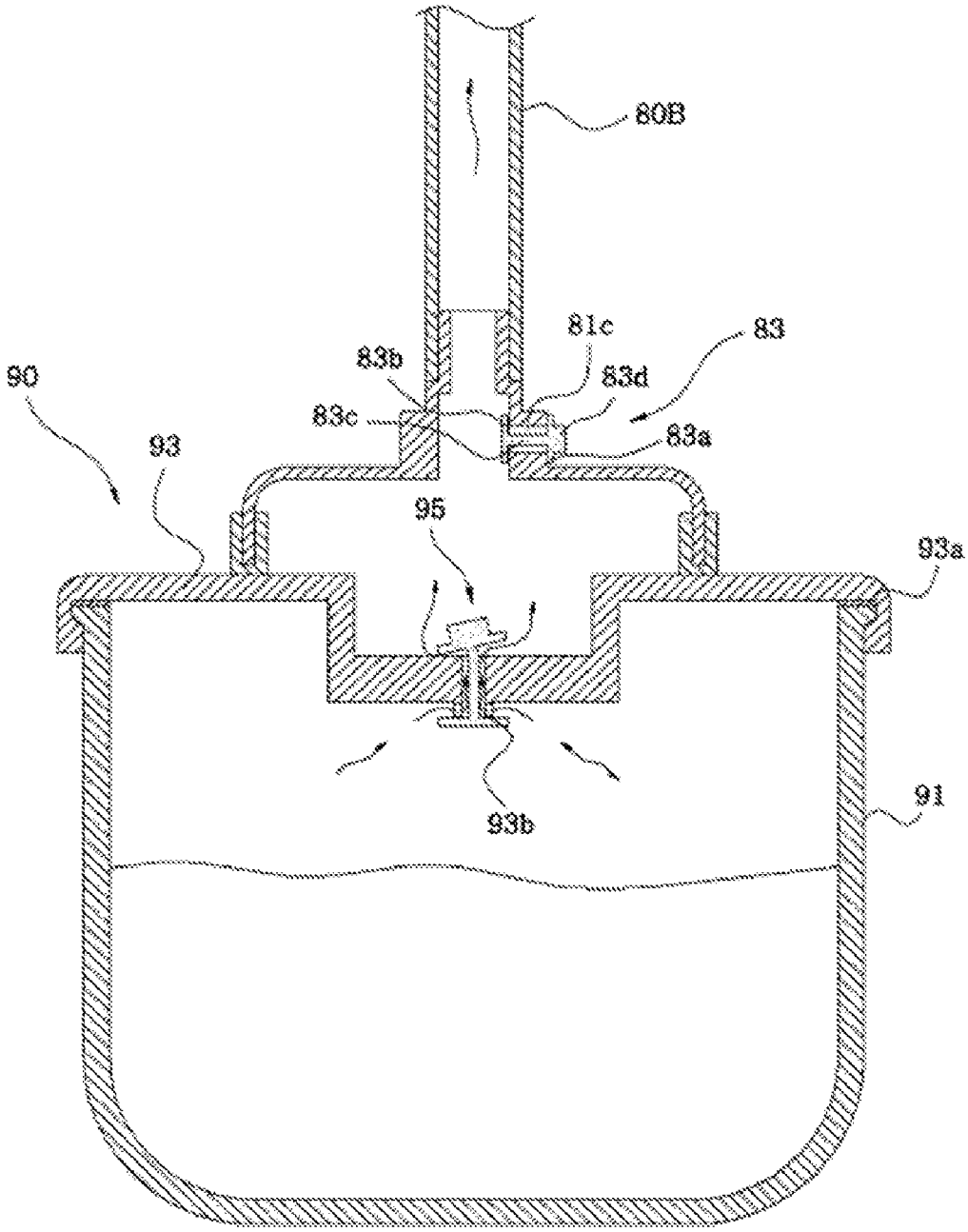

Referring to FIGS. 23 and 26, when the device has been evacuated and the connector 80 is then separated from the device, a vacuum release means is preferably used to enable easy separation of the connector from the pump and separation of the connector from the device.

As a conventional vacuum release means, a pressure release means, which was shown in FIG. 6 of Korean U.M.

registration No. 0239323, and a pressure release means, which was shown in FIG. 16 of Korean U.M. registration No. 0260856, have been proposed.

The connector 80 of the invention uses a check valve, provided on the suction part of the connector 80, as the vacuum release means. Such a construction more reliably ensures airtightness in the internal passage of the connector 80, affords easy manufacture, and makes it easy to conduct a vacuum release operation.

The check valve 83 is mounted to a mounting hole 81*c* which is formed between the edge 81*a* and the coupling protrusion 81*b* of the suction part 80A. The valve 83 is made of soft rubber or a synthetic resin material, and includes an inner disc 83*b* contacting the inner wall of the connector, an outer disc 83*a* contacting the outer surface of the suction part, and a coupling part 83*c* which couples the inner and outer discs 83*b* and 83*a* with each other and is positioned in the mounting hole 81*c*. Further, a gripping part 83*d* is provided on the valve 83, so that a user grips the gripping part with his or her hand and pulls the outer disc 83*a*, thus supplying air to the internal passage of the connector 80.

The operation and effects of the universal connector, which is constructed as described above, will be described in detail with reference to the accompanying drawings.

As shown in FIG. 25, the pointed end of the coupling part 180C is inserted into the nozzle 241 of the vacuum sealer V3. As shown in FIG. 26, the packing ring 82 of the suction part 80A is positioned above a check valve 95, which is provided on the lid 93 of the device to be evacuated, that is, a vacuum vessel 90.

Next, when the pump of the vacuum sealer V3 is operated, suction force is generated in the nozzle 51*a*. The suction force presses the coupling part 180C of the connector towards the nozzle. Thus, the outer circumferential surface of the coupling part is securely coupled to the inner circumferential surface of the nozzle. The suction force of the pump sequentially acts on the nozzle 51*a*, the coupling part 180C, the tube 80B, and the suction part 80A, as shown in FIG. 26. At this time, the upper disc of the check valve 95 of the vacuum vessel 90 is opened, so that a path 93*b* is opened. Thereby, air contained in a main body 91 is discharged through the nozzle 51*a*, so that a vacuum is created in the vessel 90. A packing ring 93*a* is provided between the lid 93 and the main body 91 of the vacuum vessel 90, thus more securely sealing the vessel.

After the vessel 90 has been evacuated, the switch of the vacuum sealer is turned off. At this time, since vacuum pressure acts on the internal passage of the connector, it is necessary to release the vacuum pressure from the internal passage of the connector so that the suction part 80A of the connector can be easily separated from the vessel 90 and so that the coupling part 180C can be easily separated from the nozzle 51*a*. To accomplish this, a user grasps the gripping part 83*d* of the check valve 83, which is provided on the suction part 80A, and pulls the outer disc 83*a*. At this time, air flows through the mounting hole 81*c* into the connector, thus releasing vacuum pressure.

As described above, the present invention provides a vacuum sealer, in which a sealing member, especially a packing member provided on a lower body, has a linear shape, thus simplifying the construction of the vacuum sealer. According to the present invention, a vacuum sealer has a vacuum release means which uses a solenoid valve so as to release a vacuum by supplying external air into a vacuum space, after air is exhausted from a vacuum bag and the end of the vacuum bag is heated to be sealed, thus affording convenience. According to this invention, a vacuum channel, defining a vacuum space at which an end of a vacuum bag containing a product to be packed is located comprises a separable member, thus permitting the detachment and attachment of the vacuum channel. This invention provides a "one-sided detachable" vacuum space creating member, thus preventing leakage from occurring in an exhaust passage coupled to a vacuum pump even after the vacuum sealer has been used for a lengthy period of time, therefore increasing durability. The vacuum space creating member of this invention is constructed as follows. That is, a holding part, provided in a lower body and/or an upper body so as to provide the vacuum space creating member, and the vacuum space creating member are attached to or detached from each other using a pair of supporting parts and detaching parts, so that the supporting parts are fastened first when the holding part and the vacuum space creating member are attached to each other, and the detaching parts are detached first when the holding part and the vacuum space creating member are separated from each other. The vacuum sealer of this invention includes a one-touch type locking means, so that a locking bar is locked when the locking means is pushed once, and the locking bar is unlocked when the locking means is pushed once more, thus allowing a vacuum space, isolated from the exterior by sealing members when an upper body engages with a lower body, to be easily created or released. Further, a support means for supporting a product is provided on the front of a lower body, which is hinged to an upper body. Moreover, the support means is constructed to be retracted into and extended from the lower body. The support means may have a drawer-type structure, a foldable structure, or a partial drawer-partial foldable structure having a plurality of support pieces. Such a construction allows a longer support means to be received in the lower body, without changing the width of the lower body. Further, this support means allows the vacuum sealer to be conveniently used, carried, and stored. A silencer is applied to the vacuum sealer, thus preventing noises from being generated when evacuation is conducted using the vacuum pump.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vacuum sealer, comprising:

a lower body;

an upper body pivotably mounted to the lower body in such a way as to engage with the lower body;

a heater installed in either or both the lower body or/and the upper body, and heating and sealing a vacuum bag;

a vacuum space creating member installed in either or both the lower body or/ and the upper body, and isolating an end of the vacuum bag which is evacuated from an exterior, thus creating a vacuum space;

a vacuum pump coupled via a tube to an exhaust hole communicating with the vacuum space created by the vacuum space creating member;

a holding part formed in the lower body, the holding part having:

a first supporting part provided on one side and a first detaching part provided on another side, and a detachable member comprising a corresponding supporting part coupled to the first supporting part provided on the holding part of the lower body, and a corresponding detaching part coupled to the first detaching part provided on the holding part, wherein the vacuum space creating member is provided in the detachable member;

wherein the corresponding supporting part and the corresponding detaching part of the detachable member comprise coupling parts having elasticity, locking steps coupled to the coupling parts and catch parts coupled to the locking steps;

wherein the first supporting part and the first detaching part of the holding part of the lower body each comprise:

respective gate parts which allow the respective locking steps of the corresponding supporting part and corresponding detaching part to be moved upwards and to be removed through upper openings of the gate parts, the upper openings having areas larger than the respective gate parts;

respective locking parts which permit the passage of only the respective catch parts while preventing the upward movement of the respective locking steps of the corresponding supporting part and the corresponding detaching part by the upper openings of the locking parts having areas smaller than the respective locking steps;

wherein the gate part of the first detaching part is longer than the gate part of the first supporting part, and the locking part of the first detaching part is shorter than the locking part of the supporting part;

wherein the first supporting part and the corresponding supporting part are configured to couple to each other in a male-female coupling arrangement when the detachable member is installed in the holding part; and wherein the gate part of the first detaching part contacts the coupling part when the detachable member is attached to the holding part, and the locking step of the corresponding detaching part is configured for movement between the locking part of the first detaching part and the gate of part of the first detaching part, and is sized small enough to pass through the gate part when the detachable member is detached from the holding part.

2. The vacuum sealer as set forth in claim 1, wherein the vacuum space creating member comprises:

a linear packing member provided on the lower body; and a closed-loop shaped sealing member provided on the upper body.

3. The vacuum sealer as set forth in claim 2, wherein the lower body further comprises a guide member for guiding the end of the vacuum bag to a predetermined position in the vacuum space.

4. The vacuum sealer as set forth in claim 3, wherein the guide member comprises two or more protrusions which are arranged along an imaginary linear line, and the upper body has protrusion fitting holes formed therein so that the protrusions are fitted into the fitting holes.

5. The vacuum sealer as set forth in claim 2, wherein the lower body comprises a liquid guide channel for guiding liquid discharged from the vacuum bag.

6. The vacuum sealer as set forth in claim 5, wherein the liquid guide channel is inclined towards a suction nozzle.

7. The vacuum sealer according to claim 1, wherein the lower body comprises a depressed part.

8. The vacuum sealer according to claim 7, wherein the depressed part is formed in the detachable first member.

9. The vacuum sealer according to claim 1, further comprising:

vacuum release means, supplying air to the vacuum space on which vacuum suction force acts after the vacuum bag is sealed by the heater.

10. The vacuum sealer according to claim 9, wherein the vacuum release means comprises: a solenoid valve provided in the tube coupling the exhaust hole formed in the vacuum space with the vacuum pump, and an air inlet part supplying external air to the vacuum space through the solenoid valve, the solenoid valve of the vacuum release means coupling the vacuum pump with the exhaust hole, or coupling the air inlet part with the exhaust hole, in response to an input signal of a control unit.

11. The vacuum sealer according to claim 9, wherein the vacuum release means comprises:

a lever hinged to the upper body or the lower body;

an elastic member restoring the lever to an original position thereof;

a packing disc provided on a contact surface of the lever with the lower body or the upper body; and an air inlet part opened or closed by the packing disc, and communicating with the tube coupled to the vacuum pump.

12. The vacuum sealer according to claim 1, further comprising:

filtering means provided on the tube coupling the exhaust hole formed in the vacuum space with the vacuum pump, and filtering impurities.

13. The vacuum sealer according to claim 12, wherein the filtering means is mounted to the lower body or the upper body to be exposed outside.

14. The vacuum sealer according to claim 1, further comprising:

locking means for maintaining engagement of the upper body with the lower body.

15. The vacuum sealer according to claim 14, wherein the locking means comprises:

a button provided on an upper surface of the upper body to be exposed to the outside;

a lever provided in the upper body, and having a hook which is moved by pushing the button; and a hook coupling part provided at a predetermined position in the lower body to be coupled to the hook of the lever.

16. The vacuum sealer according to claim 15, further comprising:

vacuum release means, comprising:

an air inlet part communicating with the tube, which couples the exhaust hole formed in the vacuum space with the vacuum pump; and a control member opening or closing the air inlet part, wherein the button of the locking means moves the control member, thus opening or closing the air inlet part.

17. The vacuum sealer according to claim 14, wherein the locking means comprises:

a locking bar provided on the lower body or the upper body; and a locking unit provided on the upper body or the lower body to engage with a locking end of the locking bar, and operated in conjunction with a spring, so that, when the locking unit is pressed once, the locking bar is locked, and when the locking unit is pressed once more, the locking bar is unlocked.

18. The vacuum sealer according to claim 17, wherein the locking unit of the locking means is provided with an outer covering so as to prevent ingress of impurities.

19. The vacuum sealer according to claim 1, wherein the pump and the heater are installed in the upper body.

* * * * *